US011098444B2

(12) United States Patent
Richards et al.

(10) Patent No.: US 11,098,444 B2
(45) Date of Patent: Aug. 24, 2021

(54) COTTON PERFORMANCE PRODUCTS AND METHODS OF THEIR MANUFACTURE

(71) Applicants: Nicole M. Richards, Madison, NC (US); Thomas C. Kallish, Ossining, NY (US)

(72) Inventors: Nicole M. Richards, Madison, NC (US); Thomas C. Kallish, Ossining, NY (US)

(73) Assignee: Tommie Copper IP, Inc., Mt. Kisco, NY (US)

( * ) Notice: Subject to any disclaimer, the term of this patent is extended or adjusted under 35 U.S.C. 154(b) by 0 days.

(21) Appl. No.: 15/395,933

(22) Filed: Dec. 30, 2016

(65) Prior Publication Data

US 2017/0198432 A1 Jul. 13, 2017

Related U.S. Application Data

(60) Provisional application No. 62/275,961, filed on Jan. 7, 2016.

(51) Int. Cl.

| | |
|---|---|
| ***B32B 27/12*** | (2006.01) |
| ***D06N 3/12*** | (2006.01) |
| ***D06M 15/507*** | (2006.01) |
| ***D06M 11/83*** | (2006.01) |
| ***D06M 23/06*** | (2006.01) |

(Continued)

(52) U.S. Cl.

CPC ..... *D06N 3/125* (2013.01); *D06M 11/83* (2013.01); *D06M 15/507* (2013.01); *D06M 23/06* (2013.01); *D06N 3/0006* (2013.01); *D06N 3/0009* (2013.01); *D06N 3/009* (2013.01); *D06M 2101/06* (2013.01); *D06N 2201/042* (2013.01); *D06N 2203/065* (2013.01); *D06N 2209/141* (2013.01); *D06N 2211/10* (2013.01);

(Continued)

(58) Field of Classification Search

CPC ..... B32B 27/12

See application file for complete search history.

(56) References Cited

U.S. PATENT DOCUMENTS

| | | | |
|---|---|---|---|
| 1,102,178 | A | 6/1914 | Wescott |
| 3,642,428 | A | 2/1972 | Getchell et al. |

(Continued)

FOREIGN PATENT DOCUMENTS

| | | | |
|---|---|---|---|
| CN | 103194830 | A | 7/2013 |
| JP | S6094682 | A | 5/1985 |

(Continued)

OTHER PUBLICATIONS

Machine Generated English Translation—Patent & Utility Model No. JP58220844A; Title: Offset Water Absorbing Fabric; Inventor: Amamiya Kunio, et al.; Applicant: Unitika Ltd.; Publication Date: Dec. 22, 1983.; 5 Pages.

(Continued)

*Primary Examiner* — Andrew T Piziali

(74) *Attorney, Agent, or Firm* — St. Onge Steward Johnston & Reens LLC

(57) ABSTRACT

Performance fabrics and methods of manufacturing them where the fabric is knit or woven cotton and cotton elastane blends to which a moisture-management treatment of wax or wax emulsion is applied to one side of the woven or knitted fabric. The treated fabric is wicking, absorbent and not water repellant or water resistant.

19 Claims, 16 Drawing Sheets

(51) Int. Cl.
*D06N 3/00* (2006.01)
*D06M 101/06* (2006.01)

(52) U.S. Cl.
CPC .... *D10B 2201/02* (2013.01); *D10B 2401/022* (2013.01); *D10B 2501/00* (2013.01)

(56) References Cited

U.S. PATENT DOCUMENTS

| | | | | |
|---|---|---|---|---|
| 3,661,692 | A | 5/1972 | Berczi | |
| 3,838,692 | A | 10/1974 | Levesque | |
| 3,907,499 | A | 9/1975 | Ingram et al. | |
| 4,507,355 | A | 3/1985 | George et al. | |
| 4,540,617 | A | 9/1985 | Kawanishi et al. | |
| 4,618,522 | A | 10/1986 | Modic | |
| 5,089,296 | A | 2/1992 | Bafford et al. | |
| 5,747,392 | A | 5/1998 | Xiao et al. | |
| 5,932,253 | A | 8/1999 | Trinh et al. | |
| 6,001,935 | A * | 12/1999 | Palmer, Jr. | C08L 67/025 524/539 |
| 6,124,221 | A * | 9/2000 | Gabbay | A47G 9/0238 2/69 |
| 6,194,332 | B1 | 2/2001 | Rock et al. | |
| 6,475,934 | B1 | 11/2002 | Nonaka et al. | |
| 6,488,718 | B1 | 12/2002 | Rearick | |
| 6,491,727 | B1 | 12/2002 | Rearick et al. | |
| 6,528,438 | B2 | 3/2003 | Payet | |
| 6,602,811 | B1 | 8/2003 | Rock et al. | |
| 6,749,641 | B2 | 6/2004 | Cates et al. | |
| 6,936,076 | B2 | 8/2005 | Cates et al. | |
| 7,008,887 | B2 | 3/2006 | Rearick et al. | |
| 7,037,346 | B2 | 5/2006 | Cates et al. | |
| 7,083,828 | B2 | 8/2006 | Muller et al. | |
| 7,297,643 | B2 | 11/2007 | Cates et al. | |
| 7,300,547 | B2 | 11/2007 | Luu et al. | |
| 7,399,519 | B2 | 7/2008 | Fang et al. | |
| 7,517,819 | B2 | 4/2009 | Klutz et al. | |
| 7,524,551 | B2 | 4/2009 | Fang et al. | |
| 7,531,219 | B2 | 5/2009 | Rubin et al. | |
| 7,531,598 | B2 | 5/2009 | Muller et al. | |
| 7,700,500 | B2 | 4/2010 | Jordan et al. | |
| 7,781,502 | B2 | 8/2010 | Cheng et al. | |
| 7,842,625 | B1 | 11/2010 | Stockton et al. | |
| 7,846,296 | B2 | 12/2010 | Luu et al. | |
| 7,879,743 | B2 | 2/2011 | Bringley et al. | |
| 7,906,177 | B2 | 3/2011 | O'Rear et al. | |
| 7,919,417 | B2 | 4/2011 | O'Rear et al. | |
| 8,123,905 | B2 | 2/2012 | Luu et al. | |
| 8,129,567 | B2 | 3/2012 | Peng et al. | |
| 8,629,070 | B2 | 1/2014 | Oles et al. | |
| 8,806,663 | B2 | 8/2014 | White et al. | |
| 8,946,100 | B2 | 2/2015 | Dutkiewicz et al. | |
| 9,103,067 | B2 | 8/2015 | Jung | |
| 9,228,295 | B2 | 1/2016 | Jung | |
| 9,284,683 | B2 | 3/2016 | Arnold et al. | |
| 9,364,032 | B2 | 6/2016 | White et al. | |
| 2001/0017102 | A1 | 8/2001 | Caldwell | |
| 2001/0021616 | A1 | 9/2001 | Bullock et al. | |
| 2001/0049247 | A1 | 12/2001 | Mellea et al. | |
| 2002/0182329 | A1 | 12/2002 | O'Rear, III et al. | |
| 2004/0058072 | A1 | 3/2004 | Rearick et al. | |
| 2004/0116015 | A1 | 6/2004 | Hayes et al. | |
| 2004/0127393 | A1 | 7/2004 | Valpey, III et al. | |
| 2004/0185728 | A1 | 9/2004 | Moore et al. | |
| 2004/0238135 | A1 | 12/2004 | Edwards et al. | |
| 2004/0250969 | A1 | 12/2004 | Luu et al. | |
| 2005/0101209 | A1 | 5/2005 | Li et al. | |
| 2005/0186872 | A1 | 8/2005 | Wang et al. | |
| 2005/0229327 | A1 | 10/2005 | Casella et al. | |
| 2005/0245159 | A1 | 11/2005 | Chmielewski et al. | |
| 2005/0266753 | A1 | 12/2005 | Fang et al. | |
| 2006/0110541 | A1 | 5/2006 | Russell et al. | |
| 2006/0122323 | A1 | 6/2006 | Dumont et al. | |
| 2006/0148356 | A1 | 7/2006 | Zhang et al. | |
| 2006/0183851 | A1 | 8/2006 | Liu et al. | |
| 2006/0228964 | A1 | 10/2006 | Watkins et al. | |
| 2007/0093162 | A1 | 4/2007 | Holcombe et al. | |
| 2007/0149075 | A1 | 6/2007 | O'Rear et al. | |
| 2007/0224898 | A1 | 9/2007 | Deangelis et al. | |
| 2008/0038973 | A1 | 2/2008 | Sasser et al. | |
| 2008/0096001 | A1 | 4/2008 | Emden et al. | |
| 2008/0115290 | A1 | 5/2008 | Ellmann et al. | |
| 2008/0128044 | A1 | 6/2008 | Barak et al. | |
| 2008/0248704 | A1 | 10/2008 | Mathis et al. | |
| 2009/0233507 | A1 | 9/2009 | Gross et al. | |
| 2010/0098868 | A1 | 4/2010 | King | |
| 2010/0112204 | A1 | 5/2010 | Marte et al. | |
| 2011/0195229 | A1 | 8/2011 | Tone et al. | |
| 2011/0200820 | A1 | 8/2011 | Peng et al. | |
| 2012/0122361 | A1 | 5/2012 | Hand et al. | |
| 2013/0023171 | A1 | 1/2013 | Brown et al. | |
| 2013/0067629 | A1 | 3/2013 | Moore et al. | |
| 2013/0197133 | A1 | 8/2013 | Lewis et al. | |
| 2013/0273368 | A1 | 10/2013 | Cingolani et al. | |
| 2014/0220840 | A1 | 8/2014 | Koene et al. | |
| 2014/0352073 | A1 | 12/2014 | Goenka | |
| 2015/0059137 | A1 | 3/2015 | Ranawaka et al. | |
| 2015/0072582 | A1 | 3/2015 | Wijesena et al. | |
| 2015/0135396 | A1 | 5/2015 | White et al. | |
| 2015/0299948 | A1 | 10/2015 | Pan et al. | |
| 2016/0024333 | A1 | 1/2016 | Richards et al. | |
| 2016/0083605 | A1 | 3/2016 | Feng et al. | |

FOREIGN PATENT DOCUMENTS

| | | | |
|---|---|---|---|
| JP | S6257983 | A | 11/1989 |
| WO | 9747801 | A1 | 12/1997 |
| WO | 9955952 | A1 | 11/1999 |
| WO | 0075415 | A1 | 12/2000 |
| WO | 2007059590 | A1 | 5/2007 |
| WO | 2007068028 | A1 | 6/2007 |
| WO | 2010001386 | A1 | 1/2010 |
| WO | 2015108704 | A2 | 7/2015 |

OTHER PUBLICATIONS

Certified English Translation—Unexamined Japanese Patent Application Publication No. S56-14472; Title: Partially-Water-Absorbent Woven or Knitted Fabric; Inventor: Noriki Goto; Application: Unitika Ltd.; Publication Date: Nov. 10, 1981.; 5 Pages.

Certified English Translation—Unexamined Japanese Patent Application Publication No. S58-220873; Title: Unevenly Distributed Water Absorbent Woven or Knitted Fabric; Inventor: Takao Takeuchi; Applicant: Unitika Ltd.; Publication Date: Dec. 22, 1983.; 3 pages.

Arunangshu Mukhopadhyay, et al., "A Review on Designing the Waterproof Breathable Fabrics Part I: Fundamental Principles and Designing Aspects of Breathable Fabrics", Journal of Industrial Textiles 2008, pp. 225-262.

W D Schindler, P J Hauser, "Repellent Finishes", Chemical Finishing of Textiles Chapter 6. 2004, 15 pages.

Asit Ghosh, et al., "Coating on Viscose Fabric with Respect to Environmental Aspect", Master's Thesis, The Swedish School of Textiles, Jul. 3, 2011, 52 pages.

AATCC Test Method 201-2014, "Drying Rate of Fabrics: Heated Plate Method", Copyright © 2015 American Association of Textile Chemists and Colorists. pp. 405-407.

Phoenix Chemical Co. Inc, Safety Data Sheet, Feb. 23, 2015, 5 pages.

* cited by examiner

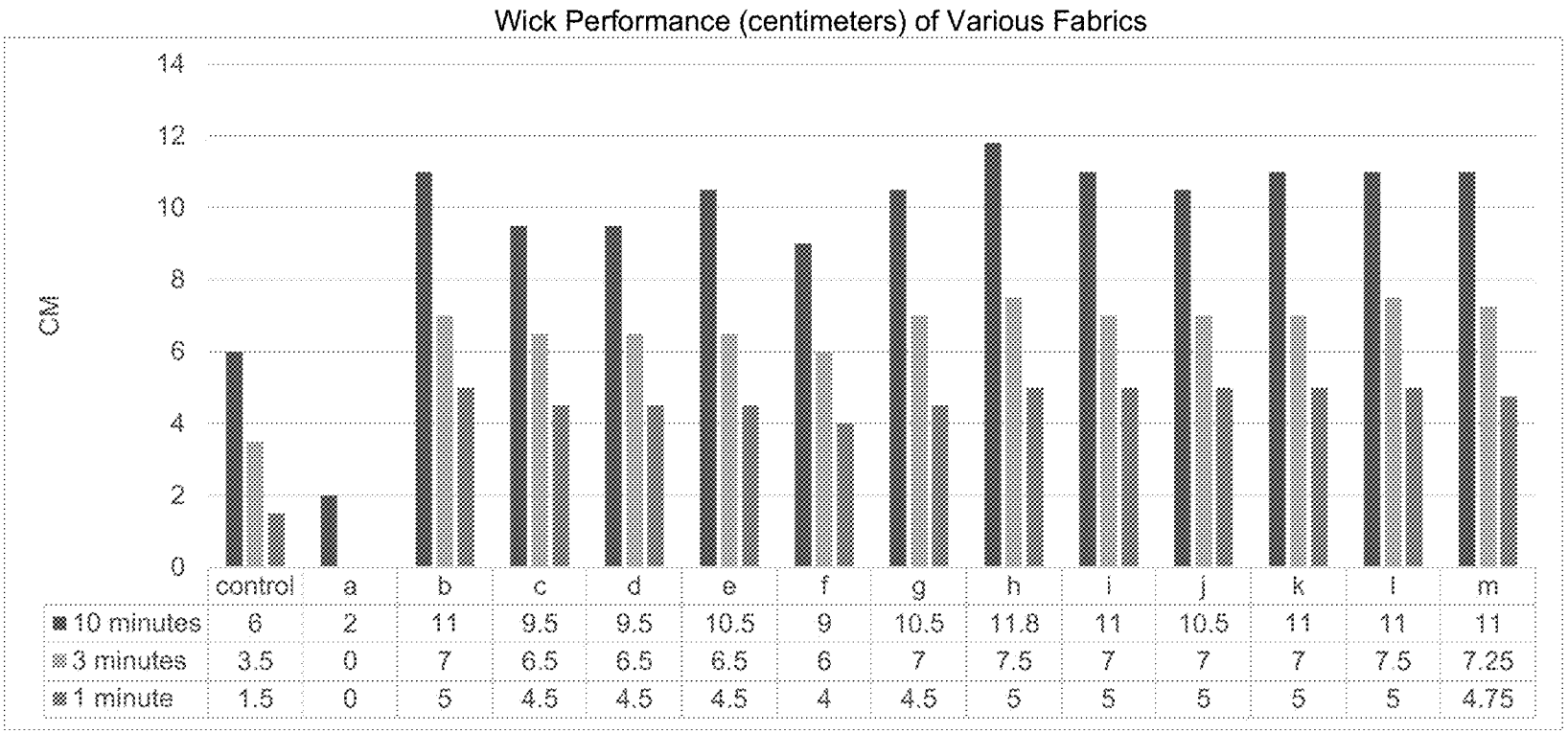

a = Under Armour 57/38/5 cotton/poly/spandex Heatgear; b = Nike 60/40 cotton/poly Dri-FIT; c = 3% by weight Finish RPW sprayed onto back; d = 3% by weight Finish RPW sprayed onto front; e = 0.1% by weight Finish RPW pad applied; f = 3% by weight Finish RPW sprayed on back and front; g = 0.1% by weight Finish RPW and 2% by weight Nylwick concentrate; h = 0.05% by weight FC6 water repellant; i = 0.05% by weight FC6 water repellant and 0.2% by weight ethox 2191; j = 0.2% by weight HCO16; k = 0.05% by weight FC6; l = 0.03% by weight FC6; and m = 0.08% by weight FC6

FIG. 5

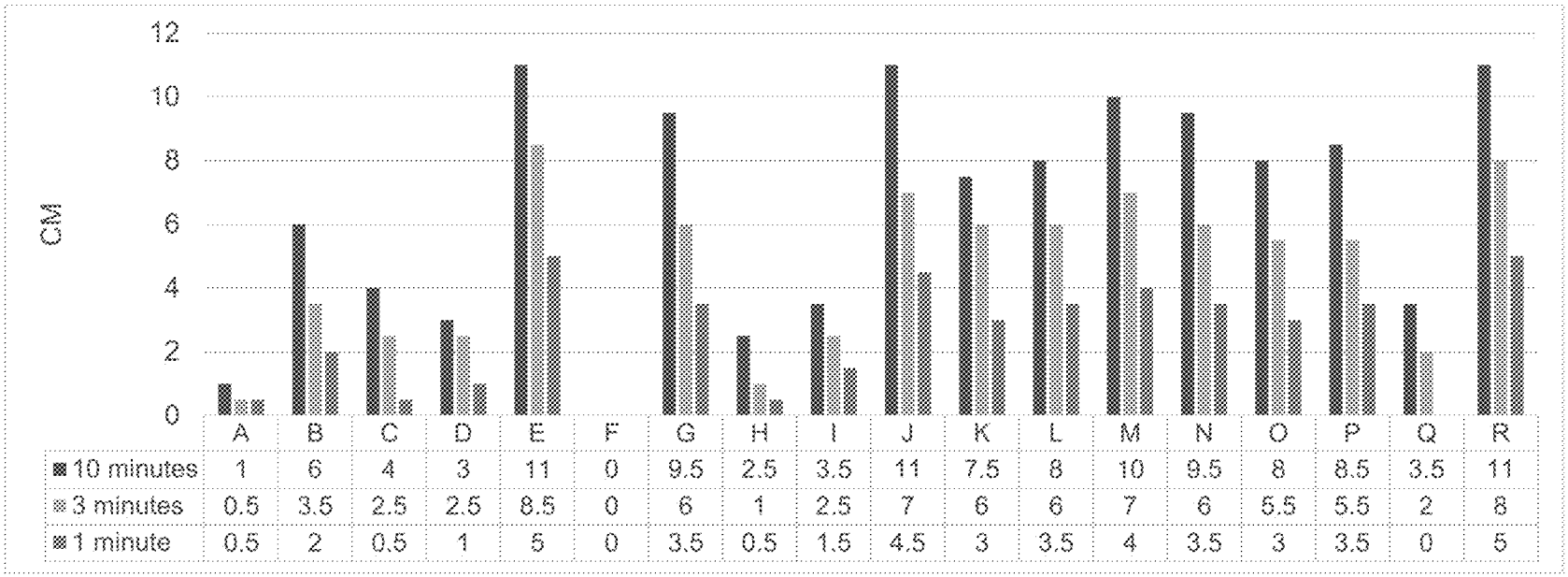

A = Champion Duodry 92% poly/8% spandex shirt; B = Final REP LS 83% poly/11% tencel/6% spandex garment; C = 100% nylon shell; D = 87% poly/13% spandex; E = Hanes X-Temp 100% cotton shirt; F = Under Armour 100% poly; G = Hanes Cool Dri 75% cotton/25% poly shirt; H = Under Armour coldgear 88% poly/12% spandex; I = Under Armour heatgear 65% poly/35%rayon; J = Fruit of the Loom 90% cotton/10% poly shirts; K = Hanes Premium 50% cotton/50% poly shirt; L = Nike 57% organic cotton/35% recycled poly/11% spandex; M = Nike 100% cotton; N = Nike 83% cotton/17% poly; O = Hanes Premium 50% cotton/50% poly; P = 50% poly/38% cotton/12% rayon; Q = 60% poly/40% nylon; R = Fruit of the Loom 100% cotton shirt

FIG. 14

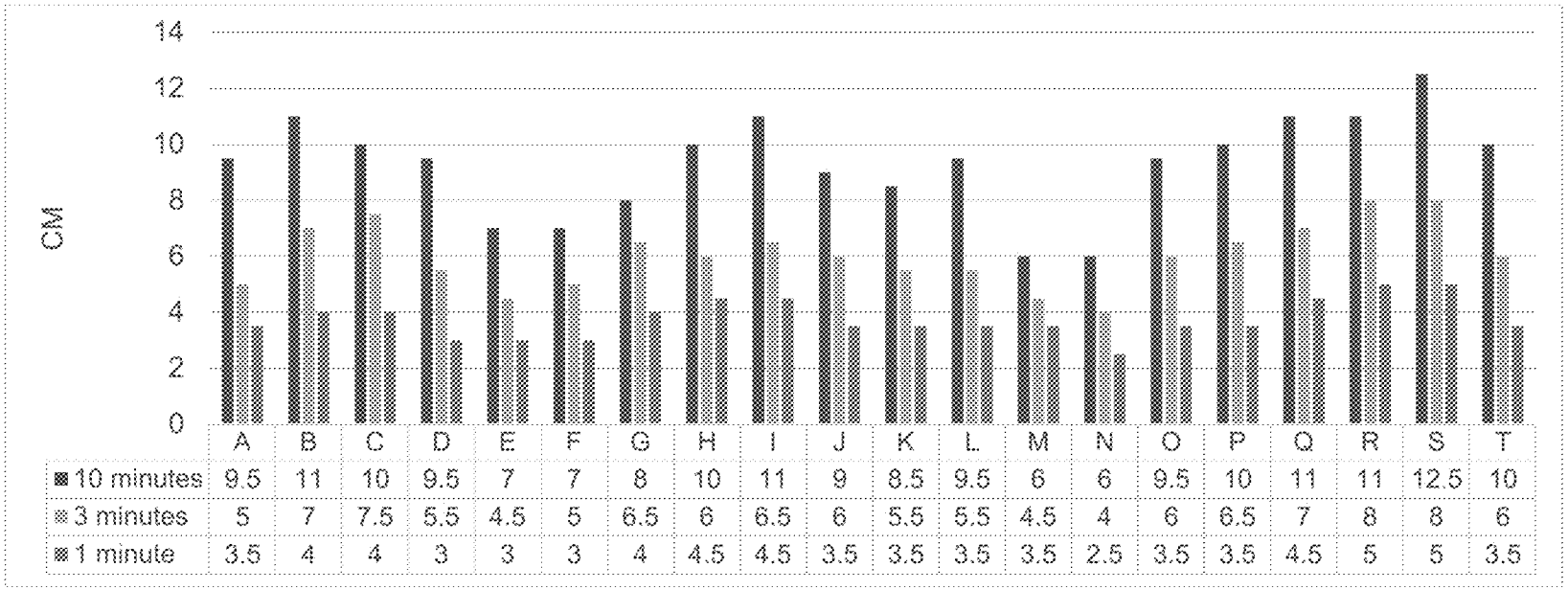

A = Champion Duodry 92% poly/8% spandex shirt; B = Final REP LS 83% poly/11% tencel/6% spandex garment; C = 100% nylon shell; D = 87% poly/13% spandex; E = Hanes X-Temp 100% cotton shirt; F = Under Armour 100% poly; G = Hanes Cool Dri 75% cotton/25% poly shirt; H = Under Armour coldgear 88% poly/12% spandex; I = Under Armour heatgear 65% poly/35%rayon; J = Fruit of the Loom 90% cotton/10% poly shirts; K = Hanes Premium 50% cotton/50% poly shirt; L = Nike 57% organic cotton/35% recycled poly/11% spandex; M = Nike 100% cotton; N = Nike 83% cotton/17% poly; O = Hanes Premium 50% cotton/50% poly; P = 50% poly/38% cotton/12% rayon; Q = 60% poly/40% nylon; R = Fruit of the Loom 100% cotton shirt treated with 2% by weight RPW; S = Nike Dri-FIT Staycool 92% poly/8% elastane shirt; T = Under Armour Heatgear 84% poly/16% elastane shirt.

FIG. 15

COTTON PERFORMANCE PRODUCTS AND METHODS OF THEIR MANUFACTURE

FIELD OF THE INVENTION

The present invention relates to quick drying and moisture absorbing cotton and cotton elastomeric blend performance fabrics and methods of manufacturing such products. More specifically, the invention relates to a method of treating a cotton or cotton/elastomeric blend garment through application of hydrophobic fluorocarbons, urethanes, silicones, waxes and wax emulsions, or any blend thereof, to finished garments or fabric products to produce fabrics and garments that have moisture-management properties superior to untreated cotton and/or equivalent or superior to synthetic performance products currently on the market.

BACKGROUND OF THE INVENTION

Moisture-management is essential in performance textiles. The request for faster drying and moisture transporting technology is required for apparel. This requirement has typically been met with either chemical modification or structural modification of synthetic fibers, such as nylon or polyester, or in a fabric construction with traditionally hydrophobic fibers that do not absorb moisture, such as polypropylene.

Commercially on the market are a wide range of moisture wicking apparel and textile products, but very few contain cotton. None are 100% cotton or cotton elastane blends. Most of the technologies currently available are modified polyesters, nylons, blends of cotton, rayon, and polyester, or blends of cotton and polyester. For instance, Under Armour Heatgear is an intimate blend of polyester and cotton. Nike Dri-FIT is a two-sided knit structure comprising polyester on the side adjacent to the wearer's skin. Manufacturing these types of fabrics is expensive and time consuming, demanding much of the performance burden be placed on fabric weave construction itself, thus increasing cost and limiting fabric styles and potentials.

The ability to impart capillary action to cellulosic hydrophilic fibers, such as cotton, would allow entry into a traditionally synthetic market. Like polyester, where chemical treatments are used to ensure wicking performance, the inventive methods are conducive to lower production cost by removing requirements from the knit or weave processes, offering lower cost and fabric selection flexibility.

Cotton fabrics are known to be soft and absorbent. This absorbency, or ability to absorb and hold moisture, limits the moisture vapor transfer to the environment from the skin and creates a wet, heavy fabric when the fabric is exposed to moisture. It is uncomfortable to the skin creating a cold, heavy, uncomfortable environment. Several approaches are known to date in processing hydrophilic fabrics, e.g., cotton, into fast drying type.

For instance, drying rate of cotton fabrics with reduced thickness tends to be equal to that of polyester fabrics. Other solutions employ the use of blends of cotton and synthetic fibers, e.g., cotton/polyester, cotton/nylon, or cotton/polypropylene, hydrophobic backing layers of silicone, or waxes on the fabric side that is close to the skin, or scouring, bleaching, and finishing of 100% cotton fabrics.

US 2008/0128044 discloses a cotton or cellulose fabric having improved moisture-management performance. The process of manufacturing such products employs consecutive steps of hydrophilization and hydrophobization, including defatting cotton or cellulose fibers and coating them with silicone nanoparticles. Yarns undergoing such treatment are then tightly woven or knitted into fabric and the improved moisture management performance is achieved by wicking moisture through open channels formed between the yarns in the fabric. This process requires two step treatment, nanoparticle technology, and subsequent knitting processes, which adds increased time and costs.

Similarly, CN 103194830 discloses a moisture-absorbing and quick drying pure cotton fabric and production method for making the same. Hydrophilic and hydrophobic treatments are applied to cotton fibers respectively, and then the fibers are blended or woven together. The hydrophilic treatment involves scouring the fiber surface to remove surface wax, then padding a hydrophilic silicone treatment onto the fibers. The fibers are then dipped in a hydrophobic treatment comprising TRW or fluropolyoxyalkylene, and dried. The fibers are then blended in various ratios.

Cotton Incorporated's U.S. Pat. No. 7,008,887 entitled "Cellulosic substrates with reduced absorbent capacity having the capability to wick liquids" is directed to cellulosic substrates with reduced absorbent capacity having the capability to wick liquids, as well as to methods of manufacturing such cellulosic substrates. Fibers and/or fabrics are treated with a hydrophobic chemical, such as Repearl F-35 fluorochemical and/or Repearl MF crosslinking agent. When applied to fabrics, areas or islands left untreated result in a discontinuous hydrophobic treatment. For instance, treatment is applied in a striped pattern, with large stripes receiving no hydrophobic treatment.

Nanotex's U.S. Pat. No. 7,842,625 entitled Methods for treating fabric to facilitate moisture transfer from one side to the other discloses methods and compositions for treating fabrics to facilitate moisture transfer from one side of the fabric to the other, and fabrics made according to such methods. The fabrics generally have one side or surface of the fabric treated with a net hydrophobic composition, whereas the opposing surface of the fabric is not treated with the net hydrophobic composition. The composition is a "net hydrophobic copolymer", a "net hydrophobic polymer blend", or a "net hydrophobic mixture of non-polymeric materials". The fabrics have a gradient that extends from a treated side of the fabric to an untreated side of the fabric, which is accomplished by controllably applying the treatment to one side, allowing it to penetrate only a fixed depth into the fabric. In addition to ensuring that a gradient is applied, the net hydrophobic compositions require a mixture of ingredients or monomers, one being hydrophilic and one being hydrophobic.

It is desired to have a simple process for preparing cotton containing performance fabrics in which fabrics that are already knit or woven are treated without nanotechnology, and preferably in a one-step application process. It is preferred the process does not require treatment with resist materials or intricate treatment patterns.

It is desired to manufacture cotton containing performance fabrics without the use of complicated polymer mixtures or copolymers.

It is desired to reduce costs and processing steps associated with manufacture of performance fabrics containing cotton.

It is further desired that such cotton containing performance fabrics can be manufactured to contain releasable metals, such as copper and zinc, which eliminate odor causing microbes on fabric and provide other well-known benefits.

Moisture-management in hydrophilic fabrics is translated into a wicking process of the liquid absorbed, in which a spontaneous transport of the liquid is driven through pores and spaces in the fabric by capillary forces. The surface tension of the liquid causes a pressure difference across the curved liquid-air (vapor) giving a liquid movement. Wicking is also affected by the morphology of the fiber surface, and may be affected by the shape of the fibers. The rate of wicking is affected by the size and geometry of the capillary spaces between fibers. Therefore, wicking can be improved by changing the fiber surface by absorption of surfactant.

Is therefore an object of the present invention to provide a process for the manufacture of yarns and fabrics, especially those comprising cotton, with improved moisture-management performance. In still another aspect of the present invention the fibers, yarns, fabrics, and end-use textiles thereof, are essentially made of hydrophilic materials, which are good water absorbents. Particularly, the fibers, yarns, and fabrics of the present invention are 100% cotton, cotton elastomeric blends, or cotton or other cellulose fibers blended with polyester or other polymeric synthetic fibers.

It is an object of the invention that fibers, yarns, fabrics, and end-use textiles thereof, are essentially made of hydrophilic materials, which are good water absorbents. Particularly, the fibers, yarns, and fabrics of the present invention are either cotton or man-made cotton or cellulose fibers, yarns and fabrics, respectively.

It is also an object of the invention to provide cotton performance products that have a more comfortable sensation upon use, and improved moisture-management, wicking, transportation, and evaporation.

It is further an object of the present invention to provide a process for the manufacture of fabrics possessing improved performance of moisture-absorption, moisture transportation, and moisture-evaporation.

Yet another object of the present invention is to provide a process for the manufacture of fabrics with improved wicking effect.

Still another object of the present invention is to provide a process for the manufacture of modified fibers within a cotton containing fabric.

It is still further an object of the invention to provide a process for the manufacture of cotton containing performance fabrics with improved moisture-management performance where the fabric can be white in color or can be died a wide variety of colors, such as blue, red, yellow, pink, green, nude, black, purple, black, brown, and/or gray.

Yet another object of the present invention is that fabrics and fibers thus manufactured are of surface area and morphology that, while being partially coated by a wax, have improved moisture-management and wicking properties.

It is still yet another object of the invention that fabrics and garments thus manufactured are further able to contain releasably bound metals and polymeric metal carriers, such as those disclosed in co-pending application Ser. No. 14/808,611. The polymeric metal carriers may be applied before or after treatments applied through the inventive methods. Preferably, the polymeric metal carrier is applied before the treatment of the invention is applied.

SUMMARY OF THE INVENTION

The foregoing objectives are achieved by provision of performance fabrics and methods for manufacturing them, the method comprising the step of applying a moisture-management treatment comprising polyurethane, fluorocarbon, wax or wax emulsion, or any combination thereof, to a woven or knitted cotton or cotton blend fabric. The cotton fabric treated with at least one of polyurethane, fluorocarbon, wax or wax emulsions, or any combination thereof has improved moisture-management properties, namely, the treated fabric is absorbent and not water repellant or water resistant. In particular, treatment of cotton fabrics with low levels of dendrimer wax allows for a simplified process to produce fabric and garments with improved moisture-management properties.

In some embodiments, the step of applying the moisture-management treatment to the fabric comprises spraying the treatment onto fabric. In other embodiments, the step of applying the treatment comprises preparing a foam comprised of the at least one silicone, urethane, fluorocarbon, wax or wax emulsion, or any combination thereof, and spreading the foam onto the fabric.

In certain embodiments, the invention provides a performance fabric comprising knit or woven fibers or yarns comprising cotton and a treatment applied to the knit or woven fibers or yarns, the treatment comprising wax or a wax emulsion, wherein the treated fabric is absorbent and not water repellant or water resistant. In some of those embodiments, the wax or wax emulsion consists essentially of a dendrimer wax. In particularly preferred embodiments where a wax or wax emulsion is used, the treatment comprises Phoenix Chemicals Finish RPW.

In other embodiments, the treatment applied to fabric comprises FC6. In other embodiments, the treatment comprises HCO16. In some embodiments, the treatment comprises Phoenix Chemicals Nylwick.

In some embodiments, the moisture-management treatment is applied to one side of the fabric.

In certain embodiments, the fabric is constructed into a garment. In some of those embodiments, the moisture-management treatment is applied to the side of the garment that will be adjacent to a wearer's skin.

In some preferred embodiments, 0.5% to 5% by weight of the moisture-management treatment is applied to the fabric. In some of those embodiments, about 1% to about 3.5% by weight of the treatment is applied to the fabric. In certain of those embodiments, about 2% to about 3% by weight of the treatment is applied after drying.

In other embodiments, 0.01% to 0.5% by weight of the moisture-management treatment is applied to the fabric. In some of those embodiments, 0.03% to 0.5% by weight of the treatment is applied. In certain of those embodiments, about 0.05% by weight of the treatment is applied after drying.

In certain embodiments, the fibers or yarns of the fabric comprise at least 50% by weight cotton. In certain of those embodiments, the fibers or yarns comprise at least 75% by weight cotton. In some of those embodiments, the fibers or yarns comprise at least 90% by weight cotton.

In certain embodiments, the fibers or yarns of the treated fabric consist of 100% cotton. In other embodiments, the fibers or yarns are a cotton elastane blend.

In some preferred embodiments, the fabric treated with a moisture-management treatment further comprises a metal treatment having a +1 or +2 oxidation. In particularly preferred embodiments, the metal is at least one of copper and zinc, or a salt thereof. In some of those embodiments, the copper and/or zinc are reactive copper and reactive zinc.

In some embodiments, the metal in the metal treatment is selected from copper (II) sulfate, zinc pyrithione, copper sulfate pentahydrate, zinc amidine, and zinc 2-pyridinethiol-1-oxide. In certain embodiments, the copper is copper sulfate pentahydrate. In some embodiments, the zinc is zinc amidine.

In some particularly preferred embodiments, the fabric has a drying rate faster than that of untreated fabric when using a heated plate apparatus. In certain particularly preferred embodiments, the fabric has a vertical wick that is greater than that of untreated fabric.

The invention also provides a method of manufacturing the aforementioned fabrics comprising spraying a wax or wax emulsion on a knitted or woven fabric comprising cotton and heating the treated fabric to 167° C. for at least 10 seconds.

In certain embodiments, the method further comprises the steps of spraying at least one water soluble copper or zinc salt or complex on the fabric and heating the fabric to between 135° C. to 140° C. for at least 10 seconds. In some of those embodiments, the steps of spraying at least one water soluble copper or zinc salt or complex on the fabric and heating the fabric to between 135° C. to 140° C. for at least 10 seconds occur before the step of spraying the wax or wax emulsion.

Advantages of the invention are that the application occurs in one step, does not require shear force on the fabric, and does not require that a hydrophilic composition be applied to the fabric before the treatment is applied. A further advantage is that the treatment only needs to be applied to one side of a finished (e.g., knitted or woven) fabric but has the ability to penetrate the fibers of fabrics to which it is applied. As such, though it only need be applied to one side of fabric, the invention is not limited by the side of a fabric to which the treatment is applied (i.e. does not have to be side adjacent to wearer's skin).

BRIEF DESCRIPTION OF THE DRAWINGS

FIG. 5 is a bar graph comparing the wick performance of various inventive fabrics to a fabric sample from an Under Armour Heatgear 57/38/5 cotton/poly/spandex garment, and a Nike Dri-FIT 60/40 cotton/poly garment.

FIG. 14 is a bar graph comparing the wick performance of various off the shelf performance and non-performance fabrics treated according to the invention.

FIG. 15 is a bar graph comparing the wick performance of various off the shelf performance and non-performance fabrics (A-Q, S, T) to a 100% cotton fabric treated according to the invention (R).

DETAILED DESCRIPTION OF THE INVENTION

Figure 1:
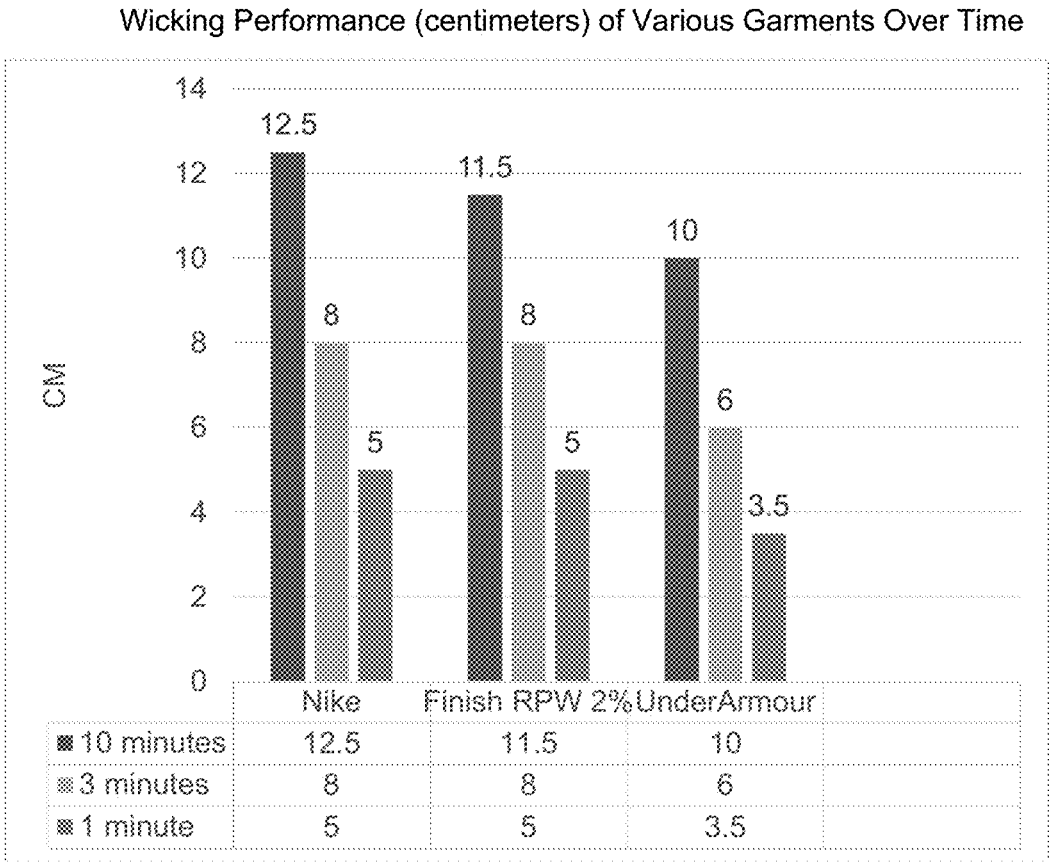
FIG. 1 is a bar graph comparing the wick performance (centimeters) of a fabric sample from a Nike Dri-FIT Staycool 92% polyester/8% elastane garment, 100% cotton fabric treated with 2% by weight RPW, and an Under Armour Heatgear 84% polyester/16% elastane garment.

The present invention relates to methods of preparing cotton containing performance fabrics that are absorbent and wicking, in that they have moisture-management properties that are equal to or better than synthetic fibers, or commercially available synthetic blends.

Moisture-management is defined in the Journal of Textile and Apparel, Technology and Management, Vol. 2, Issue 3, Summer 2002, as "the controlled movement of Water vapor and liquid Water (perspiration) from the surface of the skin to the atmosphere through the fabric". Although mostly referring to perspiration, this term may be more broadly related to release of liquid, secreted from different body organs through skin tissue, and its subsequent transport and removal from fabric.

Fabric

The term "fabric" as used herein includes textiles and textile components made from natural and synthetic materials. The fabric could include yarns and fibers. In accordance with the invention, any of these yarns or fibers may be assembled or fabricated into various types of fabrics including those involving interlocked yarns or threads formed of plied yarns and those of felt-like character in which the fibers or filaments are interlaced or interlocked with or without being adhesively bonded at their points of intersection or interlocking. The former type of fabric may be a woven, knitted, netted, knotted, or braided fabric formed of yarns comprising fibers or filaments of the type specified.

Non-woven fabrics contemplated by the present invention are also obtainable by the haphazard distribution of a multiplicity of fibers either of short lengths or of continuous length. This includes such fabrics as are obtained by carding, and if desired, superimposing a plurality of carded webs upon one another with the machine direction of the various webs disposed either parallel to one another or at various angles for the purpose of providing either anisotropy or isotropy in the characteristics of the resulting fabric, particularly as to strength and cleavage. Intermediate forms, which may also be termed hybrid forms, of fabrics may be involved such as the type of fabric known as needle felts wherein a woven or knitted fabric has fibers or filaments punched through the woven base fabric.

The various fabrics may be formed entirely of fibers, filaments, and yarns of the type defined above, but preferably, they comprise a blend of fibers or filaments of this type with fibers or filaments of other types, of predominantly natural origin. In particular, the invention is suited to cotton fibers or blends of cotton fibers with another fiber, preferably elastane.

Similarly, the fabrics may be formed of a mixture of yarns comprising fibers or filaments of the type defined above with yarns formed of other fibers, either natural or artificial. Thus, in addition to cotton, the fabrics may also comprise fibers, filaments, or yarns of wool, silk, linen, nylon, polyethylene terephthalate (e.g. Dacron), regenerated cellulose rayons, cellulose acetate, casein, vinyl resin fibers, such as copolymers of vinyl chloride and vinyl acetate or acrylonitrile, and polyesters, polyacrylonitriles, polyamides and polyurethanes and copolymers thereof. Preferred fabrics are comprised of 100% cotton or cotton and at least one of elastane, nylon, polyester, or any other elastomeric fiber, such as rubber or PPU. Particularly preferred blends are comprised of cotton and elastane, nylon, and/or polyester.

Where the fabric is a knitted or woven fabric comprised of cotton or blends of cotton and elastane, nylon, and/or polyester, it may be for example, comprised of cotton and nylon, nylon/spandex, such as nylon/Lycra®, polyester, or polyester/spandex. Where the substrate is comprised of blends, such as cotton with nylon/spandex, or polyester/spandex, the blends can have different levels of each component. Blends having up to 20% spandex yarns per square meter or square yard or by weight are preferred. The invention, however, is not limited to any particular blend or ratio of components and is dependent on the type of article being produced. The invention is specifically meant to include 100% cotton and silk or other natural fibers, and various blends thereof including, but not limited to, those with rubber. In certain embodiments, the invention utilizes fabric having at least 50% by weight cotton fibers or yarns, more preferably at least 70% by weight cotton fibers or yarns. Various types and weights of cotton may be utilized. In certain preferred embodiments the invention utilizes 30-1 to 40-1 cotton, preferably 32-1 or 40-1.

The inventive fabrics preferably take the form of a finished textile. For instance, the invention method may be applied to socks, knee sleeves, elbow sleeves, calf sleeves, core bands, ankle sleeves, back braces, shirts, tanks, jackets, shorts, pants, tights, hosiery, gloves, headbands, etc. Examples of such products are those sold by Tommie Copper. Alternatively, the article may preferably take the form of a bolt of fabric, sheet, pillow case, blanket or other type of woven or knitted home good.

The invention is not meant to be limited by the final form of the fabric or its intended use.

In one preferred embodiment of the present invention, the fabric is a knitted shirt. However, those of skill in the art will recognize that the textile article of the present inventions is not limited to shirts. Rather the textile article may be any type of textile article, such as any number and style of footwear, pants, shirts, shorts, dresses, head coverings, gloves or undergarments for example. Even still, the present inventions are not limited to garments or apparel. For example, the present inventions may include sheets of textile, e.g. sheets used for use in cut-and-sew operations.

The fabric can further have a dye affixed to it. The dye may be a basic dye, cationic dye having a positive charge, or a reactive dye. For example, the dye may be Terasil Black, Terasil Blue, Terasil Red, Terasil Yellow, Erionyl Navy, Erionyl Yellow, and Erional Red (manufactured by Huntsman Chemicals), which products are zero discharge hazardous chemicals (ZDHC), Dorolan Black MSRL (M. Dohmen) and/or Ex Acid Blue. The article may include any combination of such dyes. Reactive dyes that may be employed include Remazol Black B 133%, Remazol Br Blue BB 133%, Remazol Br Blue RW, Remazol BR. Orange 3R, Remazol Br. Red 3BS 150%, Remazol Br. Yellow 3GL gran, Remazol Deep Black GWF, Remazol Deep Black N 150%, Remazol Luminous Yellow FL, Remazol Navy Blue RGB gran, Remazol Orange RGB, Remazol Red RB 133%, Remazol Turquoise G-A, and Remazol Yellow 3RS-A 150%, available from DyStar. A great many dyes are known for dyeing fabrics, particularly cellulosics, virtually any color in the spectrum. They are readily available from a number of commercial sources. Preferably, the dyes are acidic and applied prior to the inventive treatment.

Finished articles made in accordance with the invention include black, silver, slate grey, white, blue, pomegranate, pink, nude, navy, blackberry, olive, orchid, azure, green, coral, orange, red, yellow, plum, and brown fabrics and garments. The invention is not limited by color. It is an advantage of the invention that the treatment is colorless to nearly colorless. As a result, finished garments can be white in color, or dyed to any of the aforementioned colors.

Moisture-Management Treatment

The invention comprises applying a moisture-management treatment comprising at least one of silicone, urethane, fluorocarbon, wax or a wax emulsion, or any combination thereof, to one side of the above mentioned fabrics, preferably a woven or knitted fabric to which a wax or wax emulsion is applied. The treated fabric is absorbent and not water repellant or water resistant, as is the case with prior art performance fabrics to which such treatments have been applied. As a result, the treated fabrics of the invention exhibit improved moisture-management properties over untreated cotton fabrics.

The treatment is applied to fabric at 0.01% to 5% by weight solids after drying. In some embodiments, 0.03% to 3% by weight of the treatment (solids after drying) is applied. In certain of those embodiments, about 0.05% by weight (solids after drying) of the treatment is applied. It is noted, however, that difficulties were encountered upon scale up of these low amounts. Accordingly, in preferred embodiments, 0.5% to 5% by weight of a wax or wax emulsion is applied to the fabric. In particularly preferred embodiments, 1% to 4% by weight of the treatment is applied to fabric. In some of those embodiments, about 2% to 3% by weight of the treatment is applied to fabric by weight. The inventive levels are below those traditionally used when the compounds and chemical compositions used in the inventive treatments have been applied to fabrics. It is believed that use of the much lower levels of such ingredients allows the treated fabrics to retain hydrophilic characteristics, as opposed to the water resistant and water repellant properties traditionally imparted by application of such chemicals to fabrics.

As used herein, the terms "percent", "%," "weight percent" and "wt %" all mean the percentage by weight of the indicated component or ingredient within the product or composition in which it is present, without dilution, unless otherwise indicated by the context in which the term is used. When the treatment is applied to a fabric, the "percent", "% by weight," "weight percent" and "wt %" refers to the amount applied to the fabric upon drying unless otherwise stated.

Treatment mixtures (e.g., solutions and suspensions) comprise various percentages by weight of the treatment compositions in water unless another solvent/diluent is indicated.

In some embodiments, the treatment may comprise Finish RPW dendrimer wax dispersion, Nylwick (or Nylwck) modified water dispersible polyester with ethoxylated alcohols, which are commercially available from Phoenix Chemical Company in Calhoun Ga., Apollo'Chemical's Aquatek Uno sulfonated nylon, Phoenix Chemical's Block S sulfonated nylon, and/or Phoenix's WSR XF non-fluorine water repellant, NF-21 fluorinated (C6) surfactant, HCO16 and/or ethox 2191. In some embodiments, the treatment comprises Finish Nylwck by Phoenix Chemical. In other embodiments, the treatment may comprise Permaseal WSR-XF C6 fluorocarbon and/or Innovate Chemical Technologies, Inc.'s Flexiwet NF non-fluorocarbon silicon water repellant.

The treatments are applied to fabrics at low levels not traditionally taught in the art for such applications.

In some particularly preferred embodiments, the invention comprises applying about 2% to about 3% by weight of Finish RPW dendrimer wax to cotton or a cotton elastomeric blend. Finish RPW is an off-white emulsion containing dendrimer wax Formula: $C_{142}H_{288}N_{58}O_{28}$, CAS No. 93376-66-0 and having pH 5-7. It is commercially available from Phoenix Chemical Company Inc. in Calhoun Ga. An advantage of using a dendrimer wax is that optimal amounts are able to be consistently applied, especially at commercial scale.

In some embodiments, 0.05% by weight FC6 is applied to a cotton or cotton elastomeric blend fabric.

The treatments of the invention may be applied by any method that delivers controllable continuous coverage onto a fabric surface. These methods include spray application, foaming, knife-coating, kiss-rolling, screen printing, gravure printing, and ink jet printing. These application methods may require additional chemistry be added to the formulation to enhance applicability, such as a foaming agent is necessary for foaming application, and a thickener is generally necessary for screen printing. Whatever method of application is used, the application should be controlled such that the applied chemistry uniformly covers one side of the fabric. The applied chemistry should penetrate the fabric thickness from about 25 to 75% of the fabric thickness; however no particular penetration is required. Typically, application requires a wet pick-up of 45-85%, depending on the concentration of the treatment solution, the type of fabric, and the application technique. A typical pad application assumes 70% wet pick up, however, when the pad application method is used in accordance with certain embodiments of the invention, wet pick up of 55-65% was observed.

In particularly preferred embodiments, the moisture-management treatments of the invention are applied to fabrics by means of a spray method. Spray methods include those traditionally known in the art. Spray application can be as simple as hand spraying using a squirt bottle to more complex equipment, nozzles and pumps used in the art. For instance, spray bars and nozzles supplied by Spraying Systems USA may be utilized to apply treatment to fabrics in conjunction with a controller unit.

In a commercial setting, Applicants have found success with Spray Systems equipment using 1 to 9 nozzles and 1-3 heating control units. The type of nozzle and spray pattern was found not to have a substantial effect on the performance of treated fabrics. The invention is not limited by equipment type or setup. It is envisioned that standard spraying equipment using for farming could also be utilized in the practice of the invention.

Another preferred method of applying the inventive treatments is through a foam. As mentioned, additional chemistry be added to the formulation to enhance applicability.

In certain embodiments where the treatment is applied by spraying, it is preferred to apply 25% to 35% by weight add on of treatment, preferably 28.5% to 31.5% by weight add on, most preferably around 30% by weight add on. The preparation of spray solutions and amount used in solutions will be dependent on the application method, the wet pick up of the fabric to be treated and the target add-on of the chemistry used.

Once treatment is applied, fabric is dried and cured using standard textile ovens or heating elements. The cure conditions depend on the exact type of chemistry and fabric, but generally require heating the fabric to 100° F. and not greater than 190° C., for at least 30 seconds. In certain embodiments, the treatment is heated to 375° F. for 10 minutes in a conventional laboratory oven. In other embodiments, the treatment is heated for several seconds on a frame having a temperature of about 410° F. to 425° F. In some embodiments the treatment is cured by heating to 400° F. in an oven for not less than 10 minutes. It is understood by those skilled in the art that the cure conditions will vary, depending on the type of reactive chemistry involved and the temperature exposure limitations of the fabric types.

For instance, when a dendrimer wax is utilized in the moisture-management treatment, the fabric should reach 167° C. for at least 10 second in order to fully cure the chemistry and ensure fabric durability. Equipment settings to achieve the desired fabric temperature will vary based on the type and size of equipment used. In exemplary embodiments, fabric was loaded onto a tenter frame run at 15 meters/minute and having 8 heating zones of approximately 3 meters with frame temperatures set as follows: Zone 1 and 2: 130° C.; Zone 3 and 4: 162-170° C.; Zone 5-8: 100° C.

It should be noted that not all methods of application traditionally used in the art are conducive to the inventive methods. For instance, when the pad application method was used with certain treatments desirable moisture-management properties were not observed. Roller buildup and a lack of scalability also limit application by a pad method. However, the invention is not meant to exclude pad application altogether.

Though many application methods are envisioned and may produce performance fabrics with properties of vary degree, it is preferred that the method does not involve the use of shear force to apply the inventive treatments to fabric. It is an advantage of the invention that application of sheer force is not required when applying treatments of the invention in order for the treated fabrics to achieve the moisture-management benefits of the invention.

It is further an advantage that the treatments can be applied in a continuous fashion. In particular, it is not required to treat portions of the fabric with resist chemistry. It is not required that patterns, areas or islands of the fabric avoid treatment. When spray application is utilized, no particular spray pattern is needed; the entire surface of the inventive fabric can be continuously sprayed with treatment. It is desirable that the entire length and width of the fabric is sprayed in a similar continuous fashion.

The inventors have found that a critical setting in the manufacture of inventive fabrics by a spray method is that each nozzle is delivering the same amount of treatment on a weight basis over time. If multiple spray nozzles are used, it is desirable that each nozzle has the same nozzle type, spray rate, and distance from the frame. However, the invention is not meant to exclude methods in which nozzle type, spray rate, and distance from the frame are not all the same.

Application of Reactive Metals

Optionally, the fabrics may also be treated to include at least one metal having a +1 or +2 charge. There are many health related benefits believed to be associated with metals and metal ions. For example, zinc is known to be used in the treatment of acne, dandruff, and diaper rash; as well as a natural sunscreen. Silver is known for its antimicrobial properties. Copper has been used in medicine for many years for skin repair and regeneration. Copper increases oxygen transport, neutralizes free radicals, and inhibits growth of mold and mildew. For these reasons and others, there is a desire to incorporate metals into fabrics, finished garments, and other products.

Typical sources of metal ions are any metal compounds that are soluble in water or aqueous based organic solvent systems. Suitable metal compounds include, but are not limited to, inorganic and organic metal salts such as metal sulfate, copper persulfate, metal halide, metal chlorate, metal perchlorate, metal alkanesulfonate such as metal methanesulfonate, metal alkanol sulfonate, metal arylsulfonate, metal fluoroborate, metal nitrate, metal acetate, metal citrate and metal gluconate. Exemplary metals include, without limitation, copper, tin, silver, gold, bismuth, nickel, zinc, iridium and antimony. In one embodiment, the source of metal ions is a source of copper ions. In a further embodiment, the source of metal ions is copper sulfate or copper sulfate pentahydrate. It is preferred that the metal has a +1 or +2 charge.

Mixtures of metal compounds containing the same metal or different metals may be used. Exemplary mixtures of metals include, but are not limited to, copper-tin, copper-tin-bismuth, copper-zinc, tin-bismuth, tin-copper-silver, tin-silver, and copper-silver. Such sources of metal ions are generally commercially available.

Suitable metal salts and metal complexation agents are, for example, the water-soluble salts of Ca, Mg, Ba, Al, Zn, Fe, Cr, Cu, Ni, Co and Mn or mixtures thereof. Examples of water-soluble metal salts are calcium chloride, calcium acetate, magnesium chloride, aluminum sulfate, aluminum chloride, barium chloride, zinc chloride, zinc sulfate, zinc acetate, zinc pyrithione, zinc 2-pyridinethiol-1-oxide, iron (II) sulfate, iron(III) chloride, chromium(III) sulfate, copper sulfate, copper sulfate pentahydrate, nickel sulfate, cobalt sulfate and manganese sulfate. Preference is given to using the water-soluble salts of Cu and Zn. Preferred salts and complexation agents include copper (II) sulfate, zinc pyrithione, copper sulfate pentahydrate, zinc amidine, and zinc 2-pyridinethiol-1-oxide. Copper oxides and other water insoluble copper compounds may be utilized, though are not preferred.

Preferably the metal applied is a reactive metal, such as in accordance with the treatments and application methods disclosed in U.S. patent application Ser. No. 14/808,611, the entire contents of which are incorporated herein by reference. Other ways to impart metals to fabric are well known and/or disclosed in the art, such as in WO 2015108704 and WO 2000075415, and are embodied by the invention. Application of the metal can occur before or after a moisture-management treatment is applied and can use the same equipment used to apply the moisture-management treatment. Optionally, separate equipment may be used to apply metals before or after any moisture-management treatment.

The metals may applied to the inventive fabrics by way of a polymeric carrier suspension comprising polymers synthesized from monomers selected from acrylic acids, methylacrylates and urethanes, and at least one metal having an oxidation state of +1 or +2, or salts and coordination complexes thereof, wherein the polymer is partially neutralized at the carboxyl ends. In certain embodiments, the polymer is a terapolymer. In other embodiments, the polymer is a copolymer.

The polymeric carrier suspension may further comprise an oxyalkylene poly amino ether. In some of these embodiments, the oxyalkylene poly amino ether is synthesized from 3-amino-1-propanol-2-chlorotityl ether, and at least one of styrene isoprene and styrene butadiene.

In some preferred embodiments, the polymeric carrier suspension has a pH of 6.0 to 7.0, more preferably pH of 5.5 to 7.0, a viscosity of 50 to 300 centipoise, and/or a flashpoint greater than 94° C.

In certain embodiments of the polymeric carrier suspension, the polymers are polymethyl methacrylate and/or polyhydroxypropylmethacrylate. In other embodiments, the polymers are synthesized from monomers such as urethanes. In some of those embodiments, the urethanes have prepolymers selected from the group consisting of hydroxyl-terminated polybutadienes (HTPB), hydroxy-terminated polyethers (HTPE), and hydroxy-terminated caprolactone ethers (HTCE). In certain of those embodiments, the urethane has HTPB prepolymers having an average molecular weight around 2,800 g/mol. In other embodiments where the monomer is a urethane, the urethane is comprised of hydroxy-terminated polyethers, which is a mixture of poly-1,4-butanediol and polyethylene glycol commonly referred to as TPEG.

In another particular aspect, the polymeric carrier composition comprised of polymers synthesized from monomers selected from acrylic acids, methylacrylates and urethanes; and at least one metal compound having an oxidation state of +1 or +2, including salts and coordination complexes thereof. The composition may be a solid, solution, suspension or emulsion. In preferred embodiments, the polymeric carrier composition is a suspension.

In certain embodiments, the monomers used to prepare the polymers of the polymeric composition are methyl methacrylate or hydroxypropylmethacrylate. In other embodiments, the monomers are urethanes. In certain embodiments where the monomers are urethanes, the monomers have prepolymers selected from the group consisting of hydroxyl-terminated polybutadienes and hydroxy-terminated polyethers. In other embodiments where the monomer is a urethane, the urethane has hydroxyl-terminated polybutadiene prepolymers having a molecular weight around 2,800 g/mol. In some preferred embodiments, the hydroxy-terminated polyethers comprises a mixture of poly-1,4-butanediol (poly-THF or Terathane) and polyethylene glycol (PEG), also referred to as TPEG.

The metal may be present in a carrier composition from 40% to 80% by weight in total. More preferably, the metal, such as a copper (II) salt or complex, may be present in the carrier composition from 50% to 70% by weight. Even more preferably the copper (II) salt or complex is present in the carrier composition at about 60% by weight. For a zinc compound, it may be present in the carrier composition from 0.5% to 10% by weight; more preferably, 1% to 5% by weight.

In preferred embodiments, copper is present with a polymeric carrier from 50% to 70% by weight, most preferably 60% by weight as copper sulfate or copper sulfate pentahydrate. In other particularly preferred embodiments, zinc is present with a polymeric carrier at 1% to 5% by weight as zinc pyrithione, zinc omadine or zinc 2-pyridinethiol-1-oxide. In certain particularly preferred embodiments, copper or a salt thereof is present at about 55% to 65% by weight in combination with zinc or a salt or coordination complex thereof at 1-5% by weight. In another particularly preferred embodiment, both copper and zinc are present in a 2.45:3 ratio. In certain of these embodiments, the 2.45:3 ratio is calculated based on the metal being provided as copper sulfate or copper sulfate pentahydrate and pyrithione or zinc 2-pyridinethiol-1-oxide salts.

Additional ingredients may also be included in the polymeric metal carrier system to improve mechanical properties, assist in curing and increase the stability of other components and/or the product. These include bonding agents, wetting agents, cross-linkers, plasticizers, viscosity modifiers, antioxidants, stabilizers, pH adjusting agents and catalysts. A violet/indigo dye may be added to counteract any yellow color naturally present in cotton based fabrics.

Examples of suitable solvents for the polymer carrier composition include ethanolamines and the like as well as other organic liquids which are capable of solvating the components in the polymer carrier composition. Of these, monoethanolamine is particularly preferred. Water can also be used. It is most preferable if the polymeric carrier composition is manufactured as an emulsion, solution or suspension having a flashpoint above 94° C. It is optionally diluted shortly before application to fabrics.

In particularly preferred embodiments, a polymeric carrier composition including polyurethane synthesized from a polyol and an isocyanate compound, at least one water soluble copper compound, and at least one water soluble zinc compound, said copper and zinc compounds having an oxidation state of +1 or +2 is applied to fabric. The copper and zinc are reactive and in an ionic, salt, or coordination complex form. The zinc (or copper) is added to the urethane after the urethane is formed so it is not a catalyst to create a urethane binder system. As a result, the reactivity of the metal is maintained and it stays bioavailable, as evidenced by EPA 6010 and AATCC 100 test data. It is preferred that water soluble metals be invention because they allow the metal to be reactive and bioavailable when applied with a polymeric carrier.

Reactive metals are releasably bound and are available to be transported outside the fabric after application. The metals are bound to the polymer to the extent that they remain within the polymeric carrier and are not washed out of the polymeric solution or suspension in a manufacturing step. Because of this they are transferred to fabrics to which the polymer is applied. They are also bound to the extent that they will not wash off fabric after standard machine washing of garments. They, however, are reactive because the metal ions are able to interact with bacteria to kill and/or inhibit growth.

When a polymeric carrier suspension comprising polyurethane is utilized, metal is not used to form the polyurethane polymer; it is added after the polyurethane is formed. The resulting metal ions do not leach off of the surface of fabric, but are embedded in the fabric durably and must be absorbed by osmosis by any bacteria that come into contact with a wearer.

In some preferred embodiments, reactive metals are applied by spray application as discussed above. It is preferable that fabric is fully dried and carries a pH below 7.5 and minimal alkalinity into the finish bath before any reactive metal chemistry is applied. In embodiments where reactive metals are applied by spray method, it is desirable that the fabric reaches a temperature of at least 135° C. for at least 10 seconds after the metals are applied to adequately cure the carrier materials. In embodiments where a tenter frame is utilized, it is preferred that frame temperature not exceed 140° C. in order to minimize potential colorfastness issues and ensure the fabric maintains a good hand feel.

In embodiments where metal is applied before a moisture-management treatment, the fabric treated with metal is preferably fully dried before subsequent chemistry is applied.

No difference in wick or drying performance was observed for fabrics containing a polymeric reactive metal carrier in addition to the inventive moisture-management treatments.

Example 1: Spray Application of a Moisture-Management Treatment

A 10% solution containing 30% dendrimer wax in water was sprayed onto a 174 g piece of cotton fabric (Hanes Beefy t) to theoretically apply 3% by weight solids, such that approximately 3.5 g of wax was applied to the fabric. The spray was applied by hand using a conventional squirt bottle. The fabric was heated to 400° F. in a conventional laboratory oven for at least 10 minutes.

Example 2: Spray Application of a Moisture-Management Treatment

A 5% solution containing a composition consisting of 5% fluorocarbon in water was applied to cotton fabric (Hanes Beefy t) to achieve 0.1% weight add on of treatment. The spray was applied by hand using a conventional squirt bottle. The fabric was heated to 400° F. for at least 10 minutes in a conventional oven.

Example 3: Wicking Results of Various Treatments Applied to Cotton and Cotton Blends FIGS. 1-2 and 5-15 show the vertical wicking results of various treatments applied to cotton or cotton elastane blend fabrics. The Vertical Wick Testing Method and Reporting utilized is discussed below.

Section 1.1—Sample Selection and Preparation

Measurements for wicking were conducted on a variety of different fabrics, all of which were different in construction and fiber types. Each fabric sample was marked with a color that allowed for visual recording of starting length of where liquid was poured into glass beakers. Color markers were used to mark each time period on the fabric as moisture advanced to various distances. Preparation of the samples is extremely important. Since knit fabrics are not isotropic, cutting them exactly down the warp direction is critical to moisture flow and reproducibility. Weft direction flow is much slower and can cause the moisture front to flow unevenly through the fabric.

Samples were cut in 1" wide strips by 12" long strips. Distilled water was used as the experimental wicking fluid with addition of 1-2% blue disperse dye for ease of visual marking at 1, 3, and 10 minute intervals. Fabrics were introduced to the water and time zero started when the water was poured to the start line on each vertically hanging fabric.

Section 1.2—Test Apparatus

Since there is no commercially available test apparatus for wicking, the apparatus was constructed. The frame of the apparatus was made using a cardboard box. One wooden bar was attached to the cardboard to hang the samples from by making holes in the upper sides of the box. Two sets of holes were made so that one can adjust the length of the test by sliding the bar to the desired location. Samples were suspended from the wooden bar by clips that are over and inside glass beakers. Another set of clips were attached to the bottom of the fabrics to keep them vertical and consistent when introduced to the water in the beaker. Water was added to the beakers after the fabrics were suspended. Due to the volatility of water, the apparatus was placed away from fans or vents in the exact same environmentally consistent location for all tests completed. As mentioned, the fabrics were tested with water containing a dye or color that were conducive to visual inspection of the movement of moisture. This was necessary because, with most fabrics, the human eye cannot easily detect the movement of the moisture front making it near impossible to record the data in terms of length. Fabrics were chosen in order to see the relationship to the length traveled based on fiber type and chemical treatment. A stopwatch was used to record water uptake at each interval of 1, 3, and 10 minutes.

FIG. 1 compares wicking of 100% cotton treated with 2% by weight Finish RPW applied via spray to sample of a Nike Dri-FIT Staycool white 92% poly/8% elastane garment and an Under Armour Heatgear white 84% poly/16% elastane garment. The cotton treated according the invention performed better than the Under Amour non-cotton blend and similarly to Nike Dri-FIT Staycool non-cotton blend.

Figure 2:
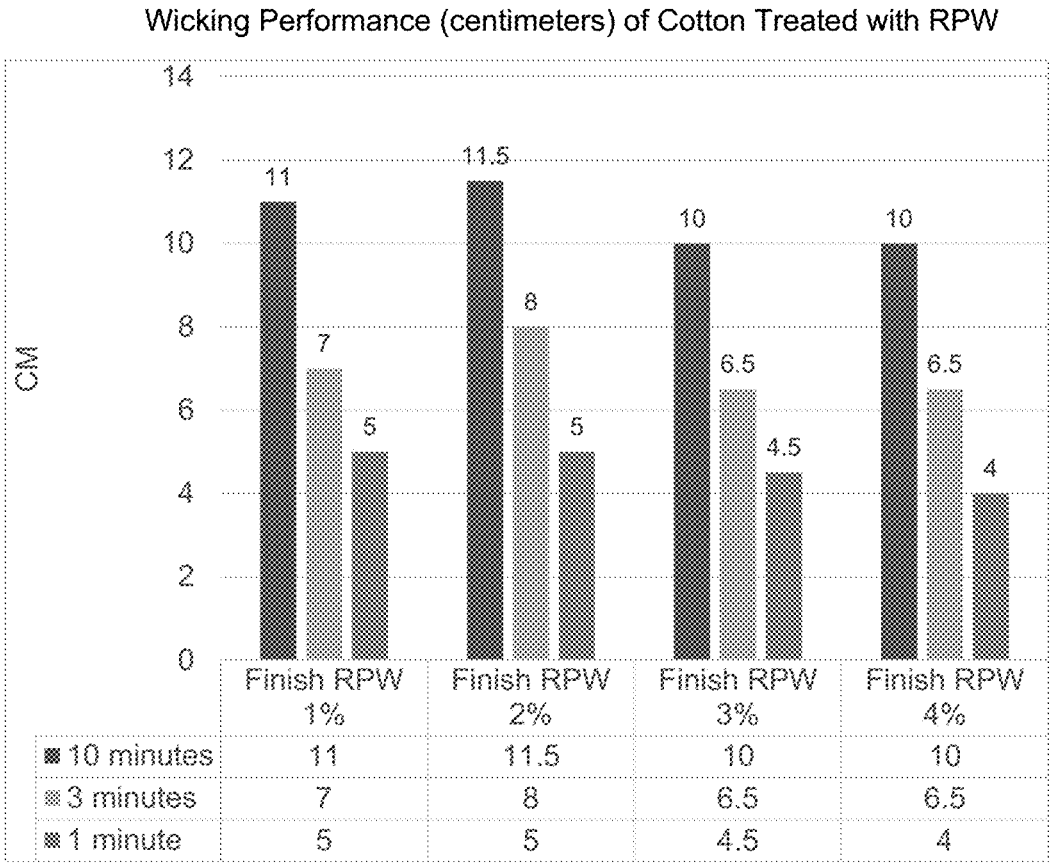
FIG. 2 is a bar graph comparing the wick performance (centimeters) of 100% cotton fabric to which various amounts (1-4% by weight) of Finish RPW was applied.

FIG. 2 compares wicking of 100% cotton treated with various amounts of Finish RPW dendrimer wax composition applied to fabric by spray application. Finish RPW applied at 1% to 4% by weight performed equal to or better than commercially available non-cotton performance fabrics and/or better than untreated cotton.

FIG. 5 compares 88/12 cotton/spandex blend from United Knitting treated with various embodiments of the inventive treatment to commercially available cotton blend performance fabrics, where a=Under Armour 57/38/5 cotton/poly/spandex Heatgear; b=Nike 60/40 cotton/poly Dri-FIT; c=3% by weight Finish RPW sprayed onto back; d=3% by weight Finish RPW sprayed onto front; e=0.1% by weight Finish RPW pad applied; f =3% by weight Finish RPW sprayed on back and front; g=0.1% by weight Finish RPW and 2% by weight Nylwick concentrate; h=0.05% by weight FC6 water repellant; i=0.05% by weight FC6 water repellant and 0.2% by weight ethox 2191; j=0.2% by weight HCO16, k=0.05% by weight FC6, I=0.03% by weight FC6, and m=0.08% by weight FC6.

All fabrics to which an inventive treatment was applied showed improved wick over the control, comparable performance to Nike Dri-FIT, and greatly improved performance over Under Armour Heat Gear. There was no observed difference in wicking properties when a wax finish was applied to the front or back of a cotton containing fabric (c and d); however, decreased performance was observed when a wax finish was applied to both sides of fabric (f).

FIGS. 6-10 compare the vertical wick in centimeters of spray application of a 10% solution of Block S 0129, Nylwick 0129, Block S 229, Nylwick 229, or Aquatek Uno 229 to untreated cotton lycra or untreated cotton jersey, respectively. The solution was sprayed to achieve the theoretical % by weight of each treatment, accounting for wet pick up. After 1, 3 and 10 minutes, all treated cotton lycra blends showed superior wicking to the control, with Block S 029 and Nylwick 029 treatments exhibiting greatest performance. However, treated cotton jersey (white, rib, black) showed no improvement over the control at each time point.

Figure 11:
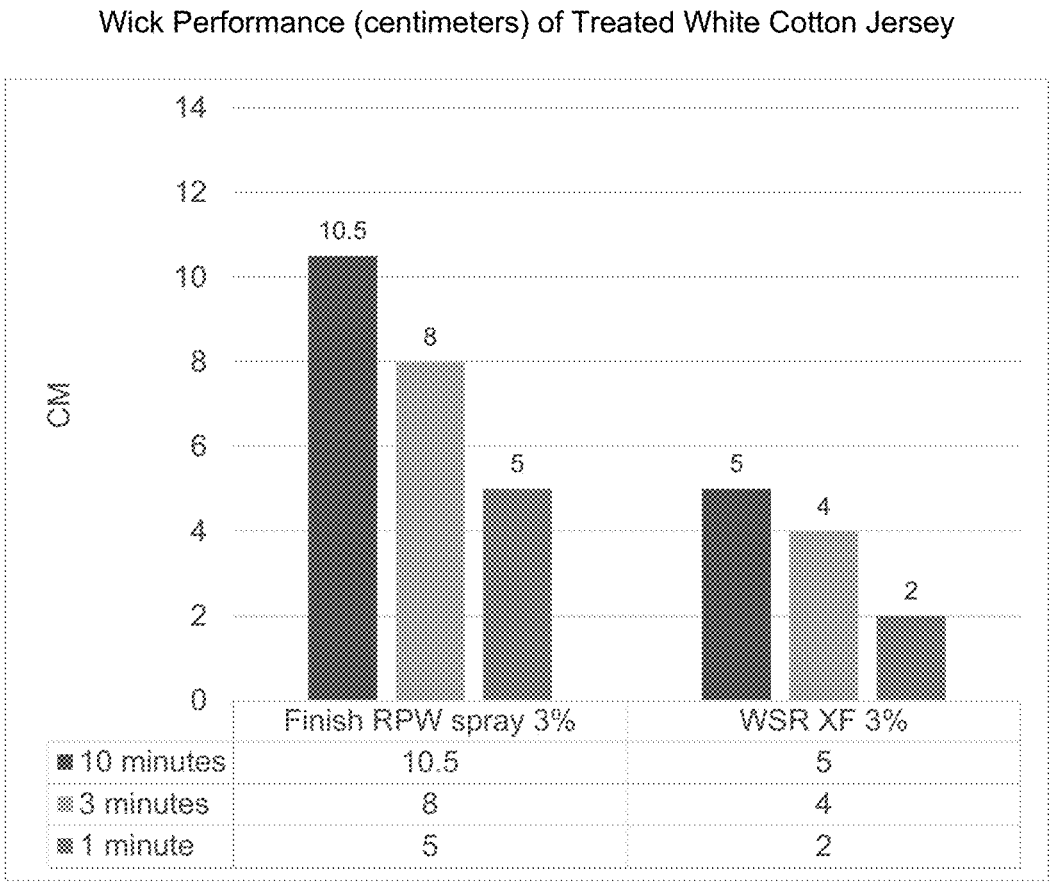
FIG. 11 is a bar graph comparing the wick performance of white cotton jersey treated with various treatments according to the invention.

FIG. 11 shows the vertical wick performance of a 10% solution of Finish RPW and WSR XF sprayed onto white cotton jersey to achieve 3% by weight of the treatment after drying. The Finish RPW treated cotton showed slightly improved wick over untreated cotton while a WSR XF treatment exhibited less wicking than untreated fabric.

Figure 12:
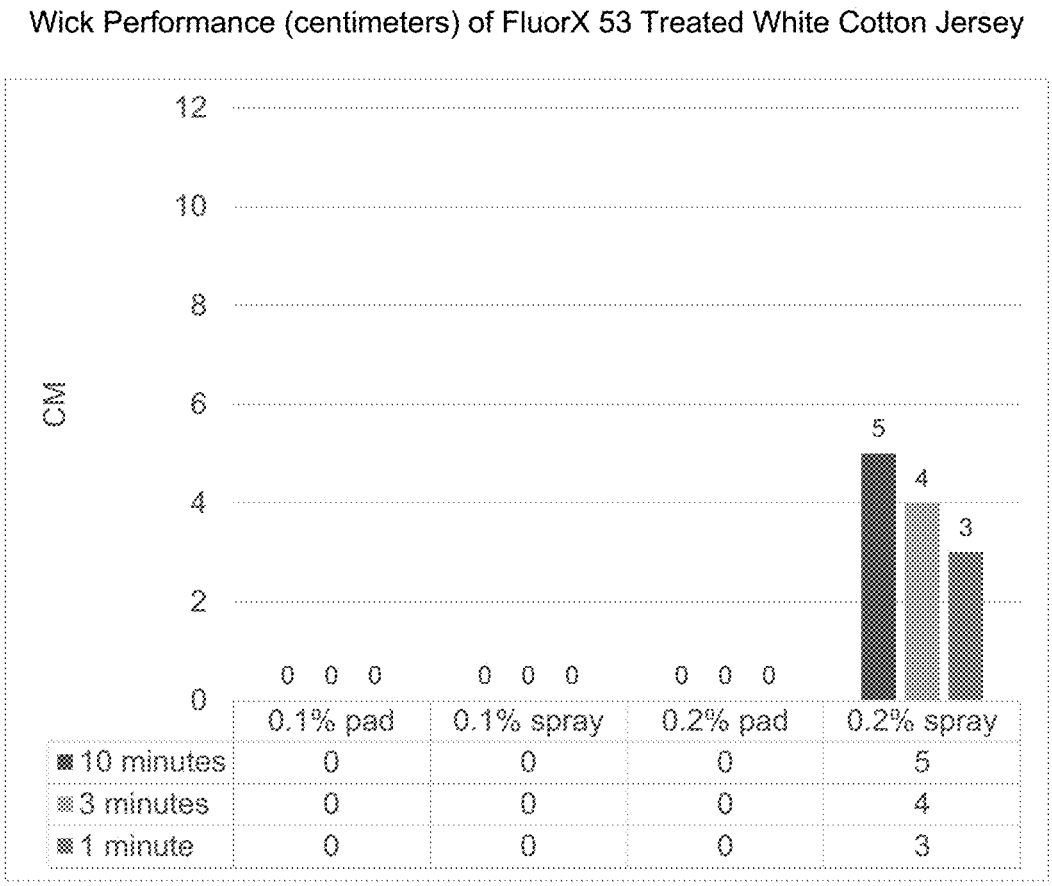
FIG. 12 is a bar graph comparing the wick performance of white cotton jersey to which various amounts (dry basis) of a 5% FluorX 53 solution were applied through pad or spray application methods.

FIG. 12 shows the vertical wick of cotton treated with a 5% solution of Finish RPW or WSR XF sprayed or padded onto white cotton jersey to achieve theoretical application of 0.1% and 0.2% by weight of treatment after drying. All exhibited poor performance compared to untreated cotton. Fabrics to which a treatment was applied with the pad method exhibited no wicking.

Figure 13:
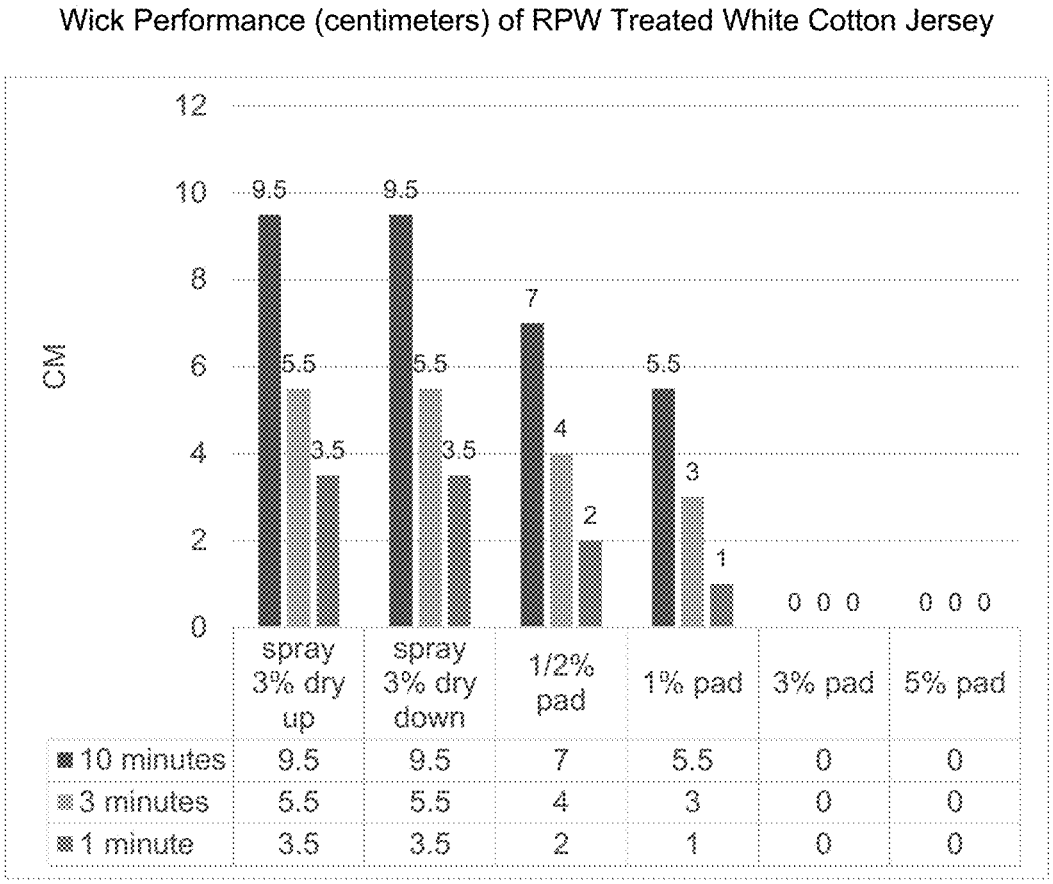
FIG. 13 is a bar graph comparing the wick performance of white cotton jersey to which 1-5% by weight RPW was applied through pad or spray application of a 10% RPW solution.

FIG. 13 shows the vertical wick of cotton treated with a 10% solution of Finish RPW sprayed or padded onto white cotton jersey to achieve various percentages by weight of treatment after drying. 3% by weight applied via spray showed comparable performance to untreated cotton, while all the pad applications exhibited poorer or no wicking.

FIG. 14 compares the vertical wick of various commercial synthetic fabrics and synthetic cotton blends treated with 2% by weight RPW dendrimer wax according to the inventive methods, where A=Champion Duodry 92% poly/8% spandex shirt; B=Final REP LS 83% poly/11% tencel/6% spandex garment; C=100% nylon shell; D=87% poly/13% spandex; E=Hanes X-Temp 100% cotton shirt; F=Under Armour 100% poly; G=Hanes Cool Dri 75% cotton/25% poly shirt; H=Under Armour coldgear 88% poly/12% spandex; I=Under Armour heatgear 65% poly/35% rayon; J=Fruit of the Loom 90% cotton/10% poly shirts; K=Hanes Premium 50% cotton/50% poly shirt; L=Nike 57% organic cotton/35% recycled poly/11% spandex; M=Nike 100% cotton; N=Nike 83% cotton/17% poly; 0=Hanes Premium 50% cotton/50% poly; P=50% poly/38% cotton/12% rayon; Q=60% poly/40% nylon; R=Fruit of the Loom 100% cotton shirt. Treating cotton rich fabrics (e.g. 50% and above) assists in wicking whereas treating fabrics rich in synthetics harms performance. Fabrics comprised of 90% or greater cotton had a vertical wick of at least 10 cm at 10 minutes. Fabrics consisting of at least 75% cotton had a vertical wick of at least 9.5 cm at 10 minutes. Fabrics consisting of at least 50% cotton had a vertical wick of at least 7.5 cm at 10 minutes.

FIG. 15 compares the vertical wick of various commercial synthetic fabrics and synthetic cotton blends to a 100% cotton treated with 2% by weight RPW dendrimer wax according to the inventive methods, where A=Champion Duodry 92% poly/8% spandex shirt; B=Final REP LS 83% poly/11% tencel/6% spandex garment; C=100% nylon shell; D=87% poly/13% spandex; E=Hanes X-Temp 100% cotton shirt; F=Under Armour 100% poly; G=Hanes Cool Dri 75% cotton/25% poly shirt; H=Under Armour coldgear 88% poly/12% spandex; I=Under Armour heatgear 65% poly/35% rayon; J=Fruit of the Loom 90% cotton/10% poly shirts; K=Hanes Premium 50% cotton/50% poly shirt; L=Nike 57% organic cotton/35% recycled poly/11% spandex; M=Nike 100% cotton; N=Nike 83% cotton/17% poly; 0=Hanes Premium 50% cotton/50% poly; P=50% poly/38% cotton/12% rayon; Q=60% poly/40% nylon; R=Fruit of the Loom 100% cotton shirt treated with 2% by weight RPW; S=Nike Dri-FIT Staycool 92% poly/8% elastane shirt; T=Under Armour Heatgear 84% poly/16% elastane shirt. The 100% cotton treated according to the invention performs as good as or better than the market performance fabrics in vertical wick. Notably, untreated 100% cotton had a vertical wick of 6-7 cm at 10 minutes whereas the treated cotton was 10 cm or greater.

Figure 3:
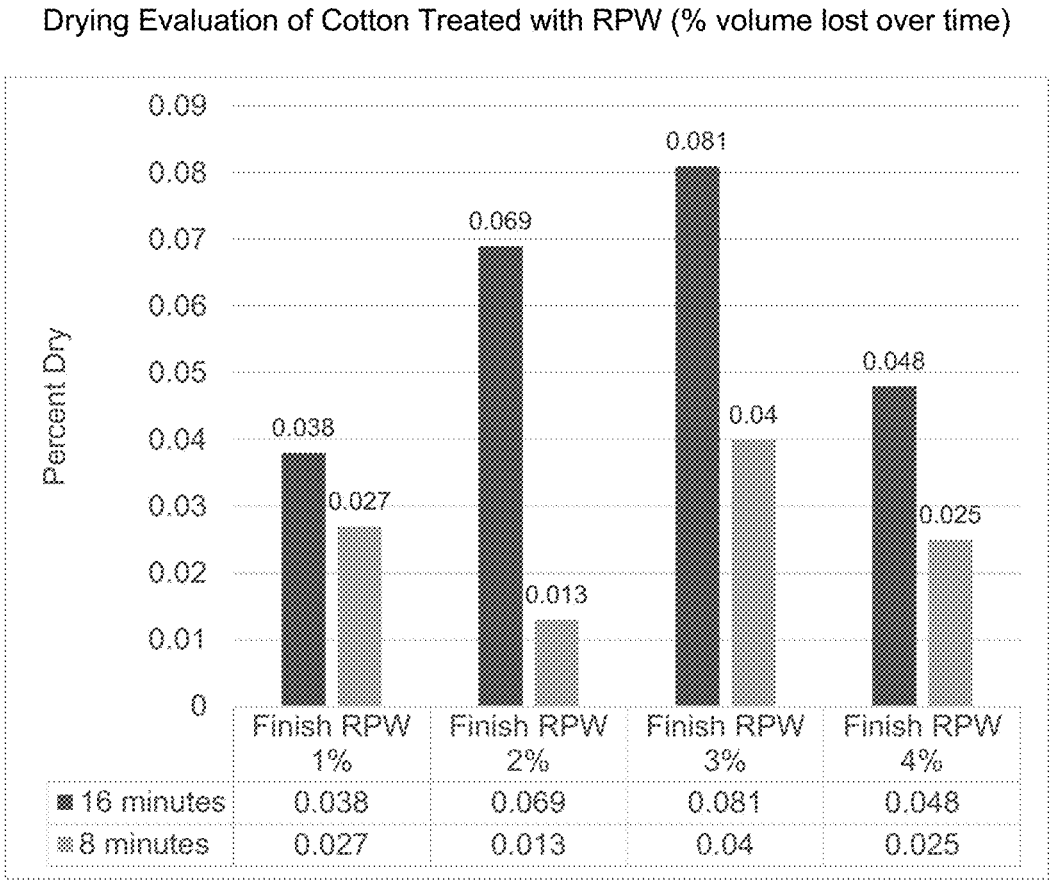
FIG. 3 is a bar graph comparing the drying (% volume lost over time) of 100% cotton fabric to which various amounts (1-4% by weight) of Finish RPW was applied.
Figure 4:
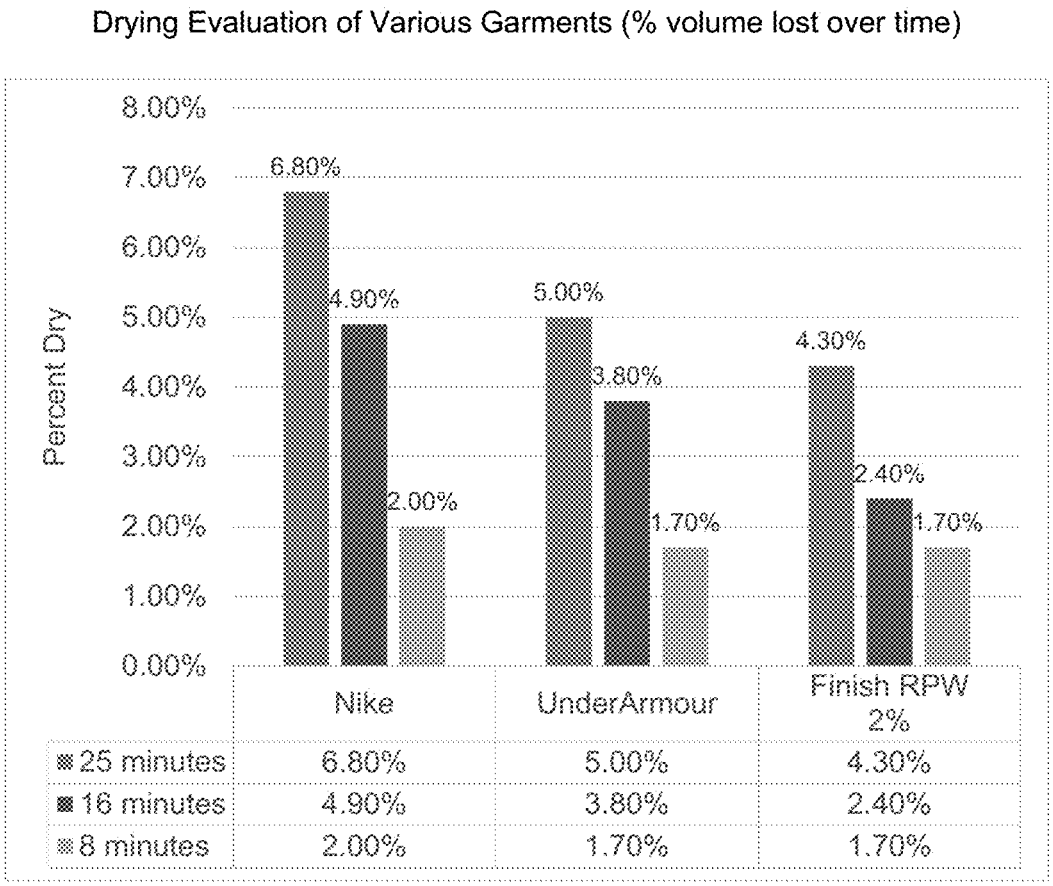
FIG. 4 is a bar graph comparing the drying (% volume lost over time) of a fabric sample from a Nike Dri-FIT Staycool 92% polyester/8% elastane garment, 100% cotton fabric treated with 2% Finish RPW and an Under Armour Heatgear 84% polyester/16% elastane garment.
Figure 6:
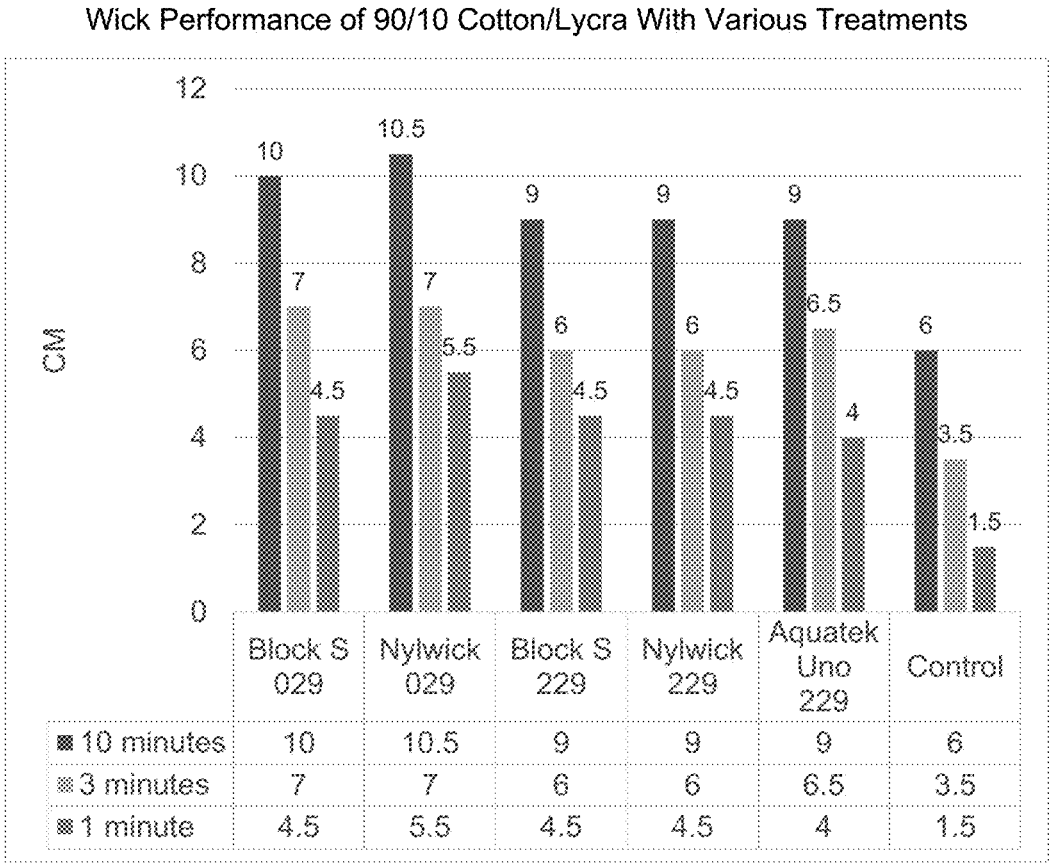
FIG. 6 is a bar graph comparing the wick performance of a 90/10 cotton/spandex (Lycra) blend spray treated with various treatments according to the invention.
Figure 7:
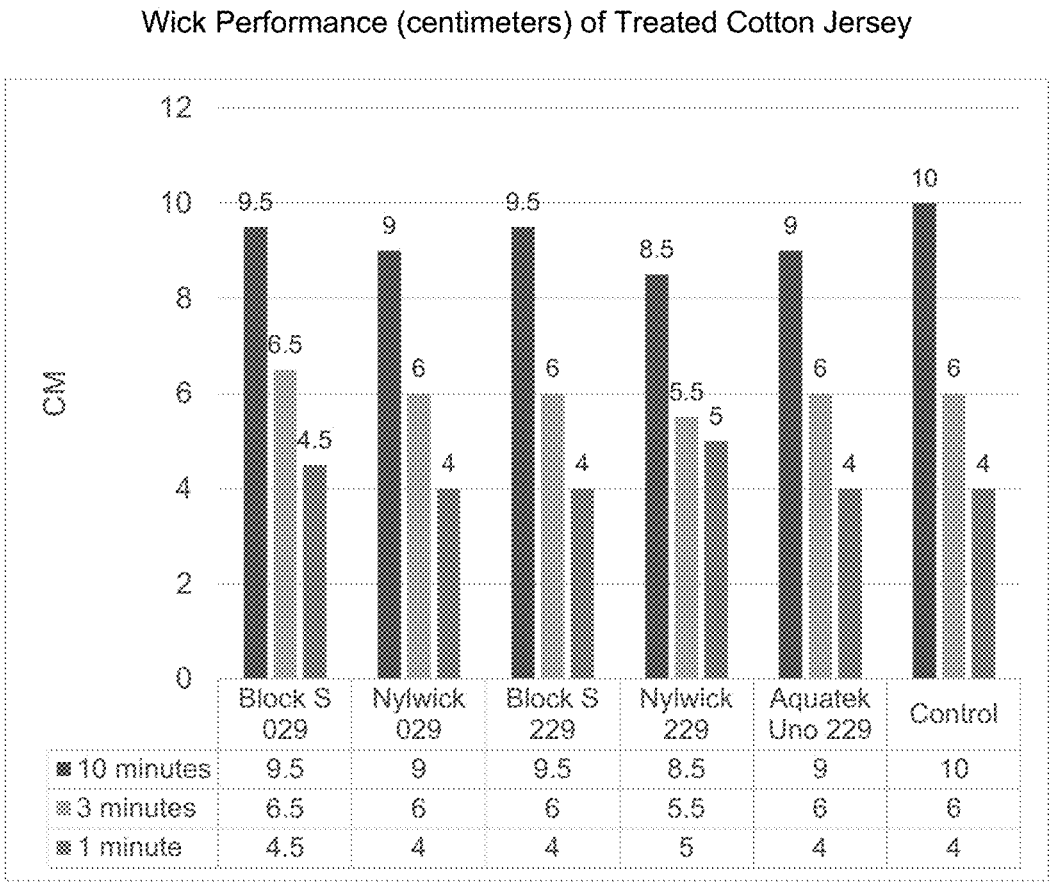
FIG. 7 is a bar graph comparing the wick performance of white cotton jersey treated with various treatments according to the invention.
Figure 8:
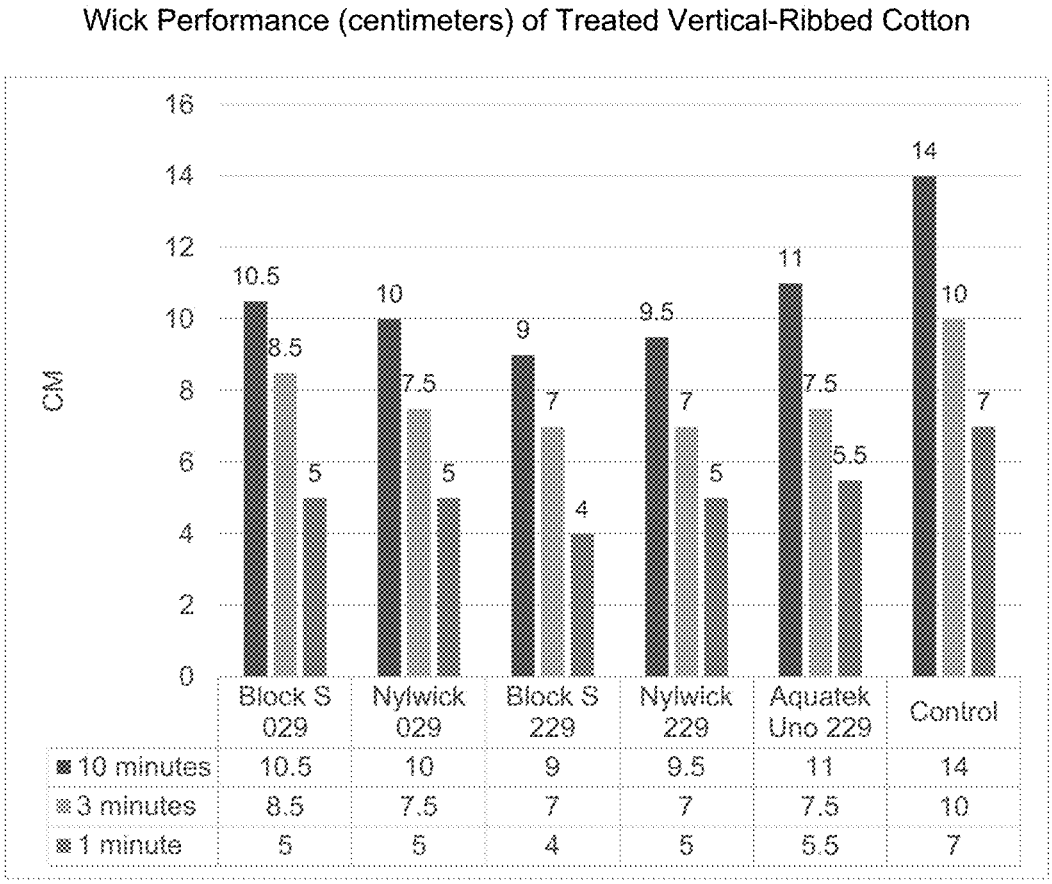
FIG. 8 is a bar graph comparing the wick performance of ribbed (vertical direction) cotton treated with various treatments according to the invention.
Figure 9:
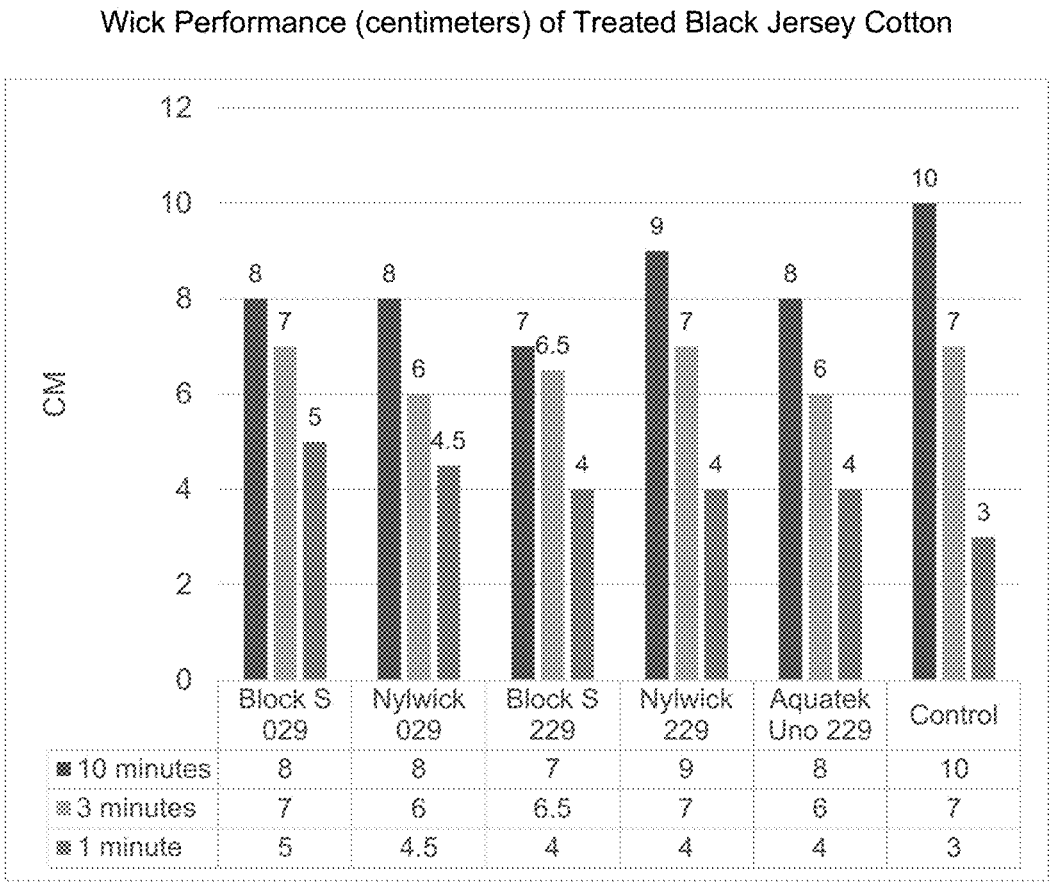
FIG. 9 is a bar graph comparing the wick performance of black cotton jersey treated with various treatments according to the invention.
Figure 10:
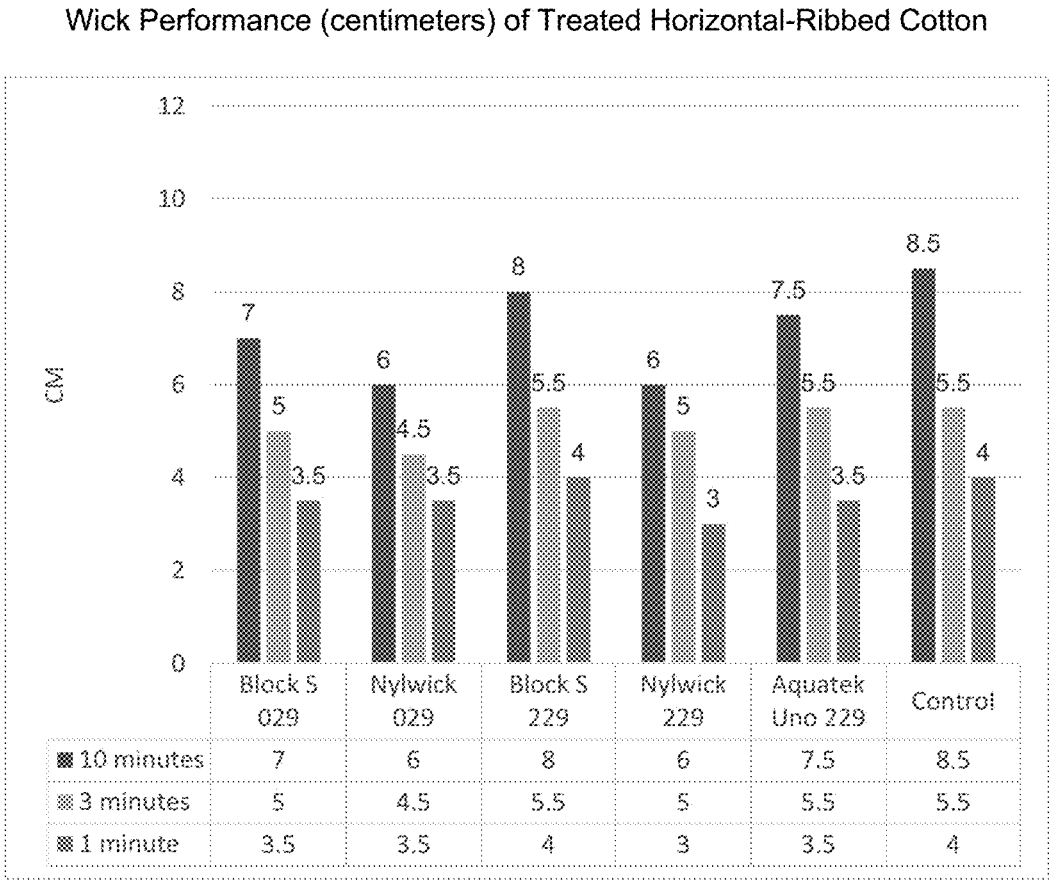
FIG. 10 is a bar graph comparing the wick performance of rib (horizontal direction) cotton treated with various treatments according to the invention.

Example 4: Drying Results of Various Treatments Applied to Cotton and Cotton Blends FIGS. 3 and 4 show the drying results of various treatments applied to cotton or cotton elastane blend fabrics. The drying testing method and reporting utilized is discussed below.

Section 1.1—Sample Selection and Preparation

Measurements for drying were conducted on a variety of different fabrics, all of which were different in construction and fiber types. Each fabric sample was marked with identifiers to distinguish the fabric. The samples were prepared in two ways.

i. Sample preparation/testing by dimension.

i.i. Cut equal with and length rectangle swatches of each fabric in a 24 cm by 13 cm rectangle.

i.ii. Dry the swatches in an oven for 8 minutes to eliminate all moisture regain from the fabric.

i.iii. Immediately weigh the fabric after removing it from the oven. This is weight initial.

i.iv. Weigh a clean, empty pipet. Fill the pipet with distilled water and weigh the pipet and water combination. Subtract the weight of the empty pipet from the water pipet combination to obtain the grams water initial.

i.v. fully saturate in the center of the fabric the water from the pipet. Hang the fabric so that air is exposed to both sides, start the timer.

i.vi. weigh each sample at 8 minutes, 16 minutes and 30 minutes, recording the weights each time in the lab notes.

i.vii. calculations of volume of water dissipating over time are based on percentage dry from each weight with starting weight being grams of fabric plus grams of water.

ii. Sample preparation/testing by weight.

ii.i. Cut equal weights of fabric, noting some fabrics will be larger than others, but each should weigh a total of 8 grams starting weight.

ii.ii. Dry the swatches in an oven for 8 minutes to eliminate all moisture regain from the fabric.

ii.iii. Immediately weigh the fabric after removing it from the oven. This is weight initial as moisture regain is accounted for.

ii.iv. Weigh a clean, empty pipet. Fill the pipet with distilled water and weigh the pipet and water combination. Subtract the weight of the empty pipet from the water pipet combination to obtain the grams water initial.

ii.v. fully saturate in the center of the fabric the water from the pipet. Hang the fabric so that air is exposed to both sides, start the timer.

ii.vi. weigh each sample at 8 minutes, 16 minutes and 30 minutes, recording the weights each time in the lab notes.

ii.vii. calculations of volume of water dissipating over time were based on percentage dry from each weight with starting weight being grams of fabric plus grams of water. Distilled water was used as the experimental wicking fluid with addition of 1-2% blue disperse dye for ease of visual examination. Water was introduced to the fabric and time zero started when the water was fully saturated into the fabric and the fabric was vertically hanging with air exposed to each side of the fabric.

Section 1.2—Test Apparatus

Since there is no commercially available test apparatus for drying, the apparatus had to be constructed. The frame of the apparatus was made using a cardboard box. One wooden bar was attached to the cardboard to hang the samples from by making holes in the upper sides of the box. Two sets of holes were made so that one can adjust the length of the test by sliding the bar to the desired location as some swatches are larger than others if testing by weight. Samples were suspended from the wooden bar by clips. Due to the volatility of water, the apparatus was placed away from fans or vents in the exact same environmentally consistent location for all tests completed. As mentioned earlier, the fabrics were tested with water that contained a dye or color that were conducive to visual inspection of the movement of moisture. This was necessary because with most fabrics the human eye cannot easily detect the movement of the moisture. The fabrics were used in order to see the relationship to the volume of water evaporated over time based on fiber type and chemical treatment. A stopwatch was used to record the water dissipation at each interval of 8, 16, and 30 minutes.

FIG. 3 compares the drying rate of cotton treated with 1-4% by weight of Finish RPW. A treatment comprising 3% by weight dries most quickly, followed by 2%, 4% and 1% respectively.

FIG. 4 compares Nike Dri-FIT Staycool 92% polyester/8% elastane, 100% cotton fabric treated with a 2% by weight Finish RPW applied via spray and Under Armour Heatgear 84% polyester/16% elastane. Initially (8 minutes), the treated cotton performs as well as the commercially available Under Armour fabric. However, drying slowed over time, likely because the treated fabric was a significantly thicker fabric; a 24 cm×13 cm fabric was 28% heavier than the competition. It is expected that thinner knits will perform equally to the commercially available Nike and Under Armour fabrics.

Figure 16:
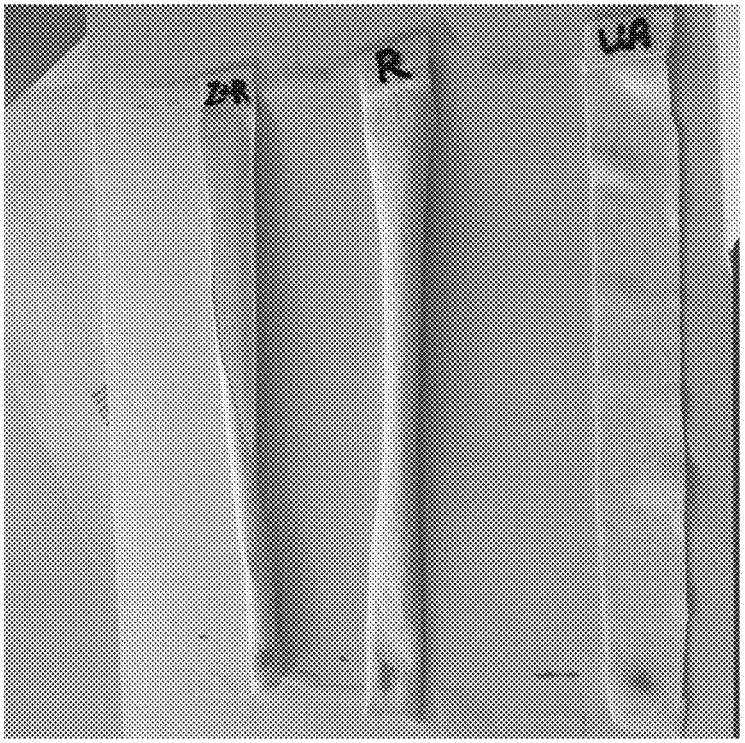
FIG. 16 is an image with results of a drop test onto a cotton fabric treated with dendrimer wax (R), a cotton fabric treated with a zinc and copper containing polymeric carrier followed by a dendrimer wax treatment (Z+R) and a sample of an Under Armour Heatgear garment (UA).

FIG. 16 shows the results of a drop test (water containing blue dye) onto a cotton fabric treated with dendrimer wax (R), a cotton fabric treated with a zinc and copper containing polymeric carrier followed by a dendrimer wax treatment (Z+R) and a sample of an Under Armour Heatgear garment (UA). The contact angle is essentially zero. All three fabrics immediately absorbed and dispersed the liquid drop. No difference was observed in the absorbent properties of the fabric treated with wax and wax+metal.

Example 5: Commercial Spray Application

A Spraying Systems USA spray bar with 9 spray nozzles model 8LPWMD and a 1008 PWM and/or 2008 driver controller was utilized to treat cotton fabric with a reactive metal solution and moisture-management treatment. Fabric was placed on a tenter frame set to run at 15 m/min with 4-8 heating zones each approximately 3 m long. The nozzles were set up approximately 37-39 cm from end to fabric at an angle of 80°. Spray was set to 132 g-182 g/min with 2-3 bars of pressure.

A reactive metal suspension was prepared by mixing 5.0% Znergy 229 (zinc amidine, copper sulfate pentahydrate, polyurethane, violet dye), available from Phoenix Chemicals, with 1.0% Ultraphil PA softener, available from Huntsman Chemicals, and 0.5% Albegal A compatibilizer, available from Huntsman Chemicals, with water at 40° C. for a minimum of 2 hours. The pH was adjusted to 7.5, as necessary.

Moisture-management treatments were prepared by making 10% to 80% solutions of Finish RPW (CCF) with water. Half of the water was placed in a drum and temperature was adjusted to below 40° C., if necessary. The remaining water was added and temperature kept below 40° C. The compositions were mixed with a clean mixing blade for a minimum of 5 minutes. The pH was adjusted to 5.5 to 7.5 with acetic acid or sodium bicarbonate, if necessary. All mixtures were used within 8 hours of preparation. The treatment mixture was filtered as it was sprayed.

In a trial run, 6.5% of a 30% spray moisture-management treatment was applied to 100% cotton with Nozzles 1 and 9 turned off and frame heating set as follows: Zone 1 and 2=130° C. or 266° F., Zone 3 and 4=162° C. or 325° F.

In a first pass, the frame was set as follows to achieve actual fabric temp of 290° F. (143° C.): Zone 1 and 2—130° C.; Zone 3 only—163° C.; Zone 4-8—100° C.

In a $2^{nd}$ pass the frame was set as follows to achieve actual fabric temp of 330° F. (166° C.): Zone 1 and 2—130° C.; Zone 3 and 4—170° C.; Zone 5-8—100° C.

In a $3^{rd}$ pass the frame was set as follows to achieve actual fabric temp=320° F. (160° C.): Zone 1 and 2—130° C.; Zone 3 and 4—165° C.; Zone 5-8—100° C.

In a 4th pass the frame was set as follows to achieve actual fabric temp of 330° F. (166° C.): Zone 1 and 2—130° C., Zone 3 and 4—167° C.; Zone 5-8—100° C.

Example 6: Commercial Spray Application

A Spraying Systems USA spray bar with 7 spray nozzles model 8LPWMD and a 1008 PWM and/or 2008 driver controller was utilized to treat fabric with a reactive metal solution and moisture-management treatment. Fabric was placed on a tenter frame set to run at 15 m/min with 8 heating zones each approximately 3 m long. The nozzles were set up approximately 37-39 cm from end to fabric at an angle of 80°. Spray was set to 132 g with 3 bars of pressure. Frame temperature was set as follows: Zone 1 and 2—130° C.; Zone 3 and 4—167° C.; Zone 5-8—100° C.

A reactive metal suspension made in accordance with the procedure of Example 5 was utilized. The suspension was applied to 7% load on 80 meters of 100% cotton fabric (32/1), 42 meters of 100% cotton (26/1), 9 meters of 60% cotton (32/1)+40% lycra, and 5 meters of 70% cotton (40/1)+30% lycra having a pH below 7.5.

A moisture-management treatment for fabrics containing lycra was prepared according to the formula below following the procedures in Example 5.

| Fabric | Fast Dry Spandex |
|---|---|
| Spray application | 30% |
| concentration of chemistry | 18.0% |
| percent solution | 60.00% |
| Volume to mix | 12 liters |
| Kg CCF to add to water | 7.20 Kg |
| Liters water | 4.80 liters |

A moisture-management treatment for cotton was similarly prepared with 60% concentration of CCF in water.

The moisture-management treatments were applied at 20% to 40% theoretical load of the treatment mixture.

The following actual wet pick ups were observed for 30% load of the treatment mixture on various fabrics:

| Fabric | WPU |
|---|---|
| 26/1 | 17.0% |
| 32/1 | 20.0% |
| 70% 40/1cotton + 30% lycra | 14.5% |
| 60% 32/1 cotton + 40% lycra | 14.6% |

Example 8: Moisture Analysis

An Ohaus MB45 Moisture Analyzer was used for moisture testing of various fabrics on an AATCC TM 201-2014 Heated Plate apparatus. Because the fabrics would not absorb the full amount of water prescribed in the AATCC method, a modified method was adopted. Fabric samples were 762 cm×762 cm square. The samples were soaked in a beaker of water for 2 minutes. After soaking, 4 layers of Bounty® Basic® paper towel were on the top and 4 layers of paper towel were placed on the bottom of the sample. A 2 lb weight was placed on top of the towel encased sample for 1 minute. The weight and paper towels were removed and the swatch was placed on the balance and the standard method was started. Time dry from being fully saturated was calculated bearing in mind that cotton retains 8% moisture at ambient conditions. The control was 100% cotton containing no moisture-management treatment or metal treatment.

All fabrics were treated with CCF and reactive copper and zinc unless otherwise indicated. Fabrics were laundered, where indicated.

| Fabric | Reactive Metal(s) | Load (%) | Dry Time (min) |
|---|---|---|---|
| Control | No | NA | 16:17 |
| 70% 40-1 cotton + 30% lycra | Yes | 22 | 22:58 |
| 100% 32-1 cotton | Yes | 22 | 21:32 |
| 70% 40-1 cotton + 30% lycra | Yes | 22 | 19:42 |
| 100% 32-1 cotton | Yes | 22 | 17:00 |
| 100% 32-1 cotton | Yes | 30 | 19:33 |
| 94% cotton + 6% lycra | Yes | 30 | 16:92 |
| 100% 32-1 cotton | Yes | 40 | 16:25 |
| 100% 32-1 cotton, compact spin | Yes | 22 | 15:58 |
| 70% 40-1 cotton + 30% lycra | Yes | 30 | 17:67 |
| 80% 40-1 cotton + 20% lycra, compact spin | Yes | 22 | 18:25 |
| 70% 40-1 cotton + 30% lycra, compact spin | Yes | 22 | 16:67 |
| 100% 32-1 cotton, 16 washes | Yes | 22 | 16:33 |
| 100% 32-1 cotton, 10 washes | Yes | 22 | 16:75 |
| 80% 40-1 cotton + 20% lycra, 10 washes | Yes | 22 | 18:92 |
| 70% 40-1 cotton + 30% lycra, 10 washes | Yes | 22 | 18:17 |
| 70% 40-1 cotton + 30% lycra, noncompact 12 washes | Yes | 22 | 17:33 |
| 70% 40/1 cotton + 30% lycra | Yes | 18 | 19:17 |
| 100% cotton | Yes | 33 | 20:09 |
| 100% cotton | Yes | 33 | 20:35 |
| 94% cotton + 6% lycra, 1 wash | Yes | 33 | 23:56 |
| 100% cotton | Yes | 22 | 12:29 |
| 100% cotton | Yes | NA | 15:36 |
| Under Armour | No | NA | 12:56 |
| 92% cotton + 8% lycra, black | Yes | 18 | 11:02 |

From the inventors' work to date, fabrics sprayed with around 18% (30% application of a 60% mixture) of a moisture-management treatment mixture on cotton/lycra blends are expected to have the lowest dry time and exhibit the best moisture-management properties.

While not wishing to be bound by any theory, fabrics treated by way of the inventive methods appear to disperse moisture by means of capillary action. The low levels of hydrophobic chemicals repel moisture enough to rapidly disperse it throughout fabric where it can be readily absorbed into atmospheric conditions. Additionally, the treatments stop the spread of dyes throughout fabrics, which may be further advantageous for containing stains or discoloration caused by concentrated perspiration, e.g. armpits.

Cotton fabrics treated by the aforementioned methods are able to withstand normal laundering conditions. To date, the fabrics maintain their moisture management properties after 30 laundering cycles. It is expected that the treated fabrics will maintain performance up to 50 laundering cycles.

Although the aforementioned detailed reference relates mostly to cotton, the inventive concept of the present invention applies equally to other raw materials, from which man-made fibers, yarns, and various types of fabrics, garments, and apparels may be produced. Cotton and cellulose, the latter also having hydrophilic tendency and good water absorption similar to that of cotton, are good examples of raw materials from which moisture-management improved man-made fibers may be produced. Such man-made fibers are, therefore, good potential candidates for the fabrication of improved moisture-management textile products according to the teaching of the present invention, while sustaining their other virtues essentially unaffected. In its broader scope, the present invention, therefore, relates also to man-made yarns and fabrics and end-uses thereof, which are made of essentially hydrophilic materials, and which are of improved moisture-management qualities according to the teaching of the present invention.

What is claimed is:

1. A moisture management treated fabric comprising:

a fabric of knit or woven fibers or yarns comprising cotton; and a treatment applied to the fabric, the treatment consisting essentially of a dendrimer wax solution, suspension or emulsion, said treatment applied to the fabric is continuous, the amount of the treatment on the fabric is 0.5% to 5% by weight solids add on after the treated fabric is dried, wherein the treated fabric has a drying rate faster than that of untreated fabric when using a heated plate apparatus.

2. The fabric of claim 1, wherein the treatment is applied to one side of the fabric.

3. The fabric of claim 1, wherein the fabric is constructed into a garment.

4. The fabric of claim 3, wherein the treatment is applied to the side of the garment that will be adjacent to a wearer's skin.

5. The fabric of claim 1, wherein the amount of treatment on the fabric is 1% to about 3.5% by weight solids add on the treatment is dried.

6. The fabric of claim 1, wherein the amount of treatment on the fabric is 2% to about 3% by weight solids add on after the treatment is dried.

7. The fabric of claim 1, wherein the knit or woven fibers or yarns comprise at least 50% by weight cotton.

8. The fabric of claim 1, wherein the knit or woven fibers or yarns comprise at least 75% by weight cotton.

9. The fabric of claim 1, wherein the knit or woven fibers or yarns comprise at least 90% by weight cotton.

10. The fabric of claim 1, wherein the knit or woven fibers or yarns consist of cotton.

11. The fabric of claim 1, wherein the knit or woven fibers or yarns are a cotton elastane blend.

12. The fabric of claim 1, further comprising at least one metal having a +1 or +2 charge.

13. The fabric of claim 12, comprising at least one of reactive copper and reactive zinc.

14. The fabric of claim 1, wherein the fabric has a vertical wick that is greater than that of untreated fabric.

15. A moisture management fabric comprising:

a fabric of knit or woven fibers or yarns comprising cotton; and 0.05% to 5% by weight dendrimer wax applied on the fabric, wherein the fabric has a drying rate faster than that of untreated fabric, said drying rate measured using a heated plate apparatus.

16. A moisture management treated fabric comprising:

a fabric of knit or woven fibers or yarns comprising cotton; and a continuous wax treatment comprising dendrimer wax in a solvent or diluent applied to the fabric, wherein the fabric contains 0.5% to 5% by weight add on dendrimer wax after the treated fabric is dried, wherein the treated fabric has a drying rate faster than that of untreated fabric when using a heated plate apparatus.

17. A method of manufacturing the treated fabric of claim 1 comprising:

spraying a wax solution or a wax emulsion on a knitted or woven fabric comprising cotton;

heating the fabric sprayed with the wax solution or wax emulsion to 167° C. for at least 10 seconds.

18. The method of claim 17, further comprising the steps of spraying at least one water soluble copper or zinc salt or complex on the fabric and heating the fabric sprayed with the at least one water soluble copper or zinc salt or complex to between 135° C. to 140° C. for at least 10 seconds.

19. The method of claim 18, wherein the steps of spraying at least one water soluble copper or zinc salt or complex on the fabric and heating the fabric to between 135° C. to 140° C. for at least 10 seconds occur before the step of spraying the wax or wax emulsion.

* * * * *